US010477936B2

(12) United States Patent
Doff et al.

(10) Patent No.: US 10,477,936 B2
(45) Date of Patent: Nov. 19, 2019

(54) INTEGRATED, MANICURE-PEDICURE STATION APPARATUS AND METHOD

(71) Applicants: Vanessa Bernadette Doff, Los Angeles, CA (US); Regina Rex Roberts, San Marcos, CA (US)

(72) Inventors: Vanessa Bernadette Doff, Los Angeles, CA (US); Regina Rex Roberts, San Marcos, CA (US)

( * ) Notice: Subject to any disclaimer, the term of this patent is extended or adjusted under 35 U.S.C. 154(b) by 561 days.

(21) Appl. No.: 14/735,949

(22) Filed: Jun. 10, 2015

(65) Prior Publication Data

US 2015/0351516 A1 Dec. 10, 2015

Related U.S. Application Data

(60) Provisional application No. 62/010,392, filed on Jun. 10, 2014.

(51) Int. Cl.

| | |
|---|---|
| ***A45D 29/18*** | (2006.01) |
| ***A45D 29/20*** | (2006.01) |
| ***A45D 29/00*** | (2006.01) |

(52) U.S. Cl.

CPC ..... *A45D 29/20* (2013.01); *A45D 29/00* (2013.01)

(58) Field of Classification Search

CPC ..... A45D 29/00; A45D 29/20

See application file for complete search history.

(56) References Cited

U.S. PATENT DOCUMENTS

| | | | | |
|---|---|---|---|---|
| 1,323,170 | A | 11/1919 | Dodge | |
| 1,380,561 | A | 6/1921 | Kaufmann | |
| 1,684,002 | A | 9/1928 | White | |
| 1,838,558 | A | 12/1931 | Kolodny | |
| 2,172,172 | A | 9/1939 | Mount | |
| 2,461,177 | A | 2/1949 | Prestien | |
| 2,477,921 | A | 8/1949 | Batton | |
| 2,547,716 | A | 4/1951 | Murphy | |
| 2,797,137 | A | 6/1957 | Forde | |
| 2,808,191 | A | 10/1957 | Cramer | |
| 2,842,141 | A * | 7/1958 | Rodrigues, Jr. ..... | A45D 29/004 118/504 |
| 3,085,842 | A | 4/1963 | Johnson | |
| 3,132,439 | A | 5/1964 | McGill | |

(Continued)

FOREIGN PATENT DOCUMENTS

| | | |
|---|---|---|
| CN | 2464142 Y | 12/2001 |
| GB | 651199 | 3/1951 |

*Primary Examiner* — Rachel R Steitz

(74) *Attorney, Agent, or Firm* — Law Office of Sam Sokhansanj PLLC

(57) ABSTRACT

A small and portable workstation for manicure and pedicure procedures may have a soft, impervious outer layer, undamaged by, yet easily cleaned with, solvents such as rubbing alcohol (e.g., 99% isopropyl) and nail polish remover (i.e., acetone). Viscoelastic "gel" skin of synthetic hydrocarbon polymer overlies a body of plastic, metal, wood, or expanded polymer (foam). An elastomeric foam such as polyurethane may contribute to flexibility and comfort, resting hand or foot on a gentle, almost horizontal, incline on the front portion of the working surface, transitioning to a wave shape of almost semicircular cross-section along the rear portion thereof. Wells hold tools and materials between organizing dividers. A removable base is a tray for supplies.

17 Claims, 32 Drawing Sheets

(56) References Cited

U.S. PATENT DOCUMENTS

| | | | | | |
|---|---|---|---|---|---|
| 3,305,076 | A | | 2/1967 | Fleenor | |
| 3,352,616 | A | | 11/1967 | Linger | |
| 3,923,356 | A | | 12/1975 | Washburne | |
| 4,075,457 | A | | 2/1978 | Williams | |
| 4,283,098 | A | | 8/1981 | Sun | |
| 4,296,766 | A | | 10/1981 | Benis | |
| 4,321,935 | A | * | 3/1982 | Sussman | A45D 29/22 132/73 |
| 4,312,507 | A | | 6/1982 | Smith et al. | |
| 4,538,861 | A | | 9/1985 | Hughes, Jr. | |
| 4,813,521 | A | | 3/1989 | Goldstone | |
| 4,915,331 | A | | 4/1990 | Becker et al. | |
| 5,014,371 | A | | 5/1991 | Heel | |
| 5,326,056 | A | * | 7/1994 | Smith | A45D 29/22 132/73 |
| 5,395,166 | A | | 3/1995 | Watson | |
| 5,501,682 | A | * | 3/1996 | Edwards-Cofie | A45D 29/22 132/73.5 |
| 5,795,219 | A | | 8/1998 | Bloom | |
| 5,913,312 | A | * | 6/1999 | Donnell | A45D 29/22 132/73 |
| 6,305,388 | B1 | * | 10/2001 | Zeller | A45D 44/02 132/287 |
| 6,349,729 | B1 | | 2/2002 | Meyer et al. | |
| 6,532,969 | B2 | | 3/2003 | Nuzzo | |
| 6,647,988 | B2 | | 11/2003 | Christianson | |
| D487,533 | S | * | 3/2004 | Abbott | A45D 29/22 D28/57 |
| 6,772,800 | B1 | | 8/2004 | Garcia | |
| 7,306,297 | B2 | | 12/2007 | Woody | |
| 8,033,285 | B2 | * | 10/2011 | Fitz | A45D 29/18 132/73.5 |
| 8,201,565 | B2 | | 6/2012 | Fernandez et al. | |
| 8,616,663 | B2 | | 12/2013 | Ton | |
| 2007/0261165 | A1 | | 11/2007 | Tran | |
| 2008/0143223 | A1 | | 6/2008 | Schuller | |
| 2010/0081367 | A1 | | 4/2010 | Tran | |
| 2011/0073123 | A1 | | 3/2011 | Ferrence et al. | |
| 2011/0289689 | A1 | * | 12/2011 | Mikkelsen | A47G 9/109 5/655.9 |
| 2013/0298926 | A1 | | 11/2013 | Smeragliuolo | |

* cited by examiner

INTEGRATED, MANICURE-PEDICURE STATION APPARATUS AND METHOD

RELATED APPLICATIONS

This application claims the benefit of co-pending U.S. Provisional Patent Application Ser. No. 62/010,392, filed Jun. 10, 2014, entitled INTEGRATED, MANICURE-PEDICURE STATION APPARATUS AND METHOD, which is hereby incorporated by reference in its entirety.

BACKGROUND

The Field of the Invention

This invention relates to cosmetology and, more particularly, to novel systems and methods for manicure and pedicure.

The Background Art

Manicure tables for professionals provide large counters or tables work space for salon workers to assist customers. Storage space abounds. Tools and materials are at the ready. Home users have no such work stations. Crowded chaos, spilled or broken bottles, and not enough holders are their lot. What is needed is a personal work station for manicure, pedicure, or both.

SUMMARY OF THE INVENTION

In view of the foregoing, in accordance with the invention as embodied and broadly described herein, a method and apparatus are disclosed in one embodiment of the present invention as including a portable, combination manicure-pedicure station suitable for solo use by a home user for his or her own nails or for a professional treating the nails of another.

A system may be folded, wrapped, encased, or otherwise fit into luggage space the size of a shoebox or boot box. Thus, convenience, storage, and easy access, to a personalized, hygienic (by avoiding public contamination by other users) system may be long lasting structurally. Solvent-safe materials may be used for the skin (or other cover) or the entire body may be molded of a solvent-safe material.

Wells formed in the system may keep polish bottles in the upright position during a treatment session to prevent spillage, eliminate dropping glass bottles that might break or damage furniture or the like.

In the illustrated embodiments disclosed herein, a system in accordance with the invention holds each selected item needed in a particular place selected by a user so that it may be accessible, yet not occupy hands, work surfaces, or the like. Meanwhile, professional or nonprofessional may use this system for major activities or very quick fixes or touch ups.

The system provides both a deck or platform portion and a pillow portion in order that hands, feet, either, or both may be positioned in a comfortable location and at an orientation that presents the readily visible access needed for treatment. A system may be placed anywhere in any position that is comfortable, including on a lap, floor, table or similar, couch, bed, or the like.

Products may be selected by a user and stored in the system for use at any time, with quick access, and ready organization.

One feature of the system in accordance with the invention is the ability to maintain comfort during the drying time or curing time for nails. Hands, feet, or both may rest comfortably during cure times as well as during application times.

In certain embodiments, the system is sufficiently small and yet may be fitted to a lightweight bag and carried by a handle or shoulder strap. Safety, simplicity, minimal stress, elimination of complexity, and use by multiple users simultaneously are all available.

In certain embodiments, the base may be provided with feet or with a material as the base material or as a cover that tends to grip. In various types of systems, polymers may be used as coatings, feet, total coatings, or particularly located in selected regions in order to render a grip against slipping along a table, floor, or the like.

The system is lightweight, soft, comfortable, stores manicure and pedicure tools and materials, and fits on a table, floor, furniture, or the like protecting such surfaces from accidental spilling of solvents, polishes, and so forth. Either foot or both feet can fit on the flat deck or platform portion or may be aligned to tilt along the pillow portion.

The pillow portion may be positioned as the portion closer to a user or further away. Typically, an individual user will place a hand or foot on the deck or the pillow portion in order to render the nails stationary, supported, comfortable, and visible.

When one individual is working on the nails of another, the subject (e.g., client) may be on one side of the unit with hands draped over the pillow portion. The manicurist or the individual applying polishes or treatments may be on the opposite side. Thus, the hands or toes may be positioned to be visible to the individual subject during self-treatment operations or to another person so doing.

Wells formed in the may hold an assortment of material since under layer, pigment layer, and lacquer layer may all be required for each nail. Meanwhile, various solvents may be available or necessary. The wells may be provided with cups that may elevate items or provide a longer (deeper) cup that will more readily hold, for example, tools in a substantial vertical orientation for easy access without touching horizontal surfaces.

For example, if a tool such as a stick, a Q-tip (swab), or the like is lying on a surface, then to pick that item up may compromise uncured polish that has already been applied on the fingers that are picking up that item. Approaching the horizontal surface closely enough to pick up that article with fingertips will typically expose the nail to touching the surface and thereby damage the uncured polish.

In contrast, if elongate members, particularly those of smaller comparative diameter such as cuticle sticks and the like, may be oriented to remain vertical and separated, then a user may easily grasp such an article with no danger of damaging an uncured polish finish.

The system may have a number of openings, boxes, trays, and the like. In fact, a softer bed (deck and pillow) may actually form a lid of a box. The box may provide permanent storage, the lid providing the deck or platform portion and pillow portion spaced by the box some distance above a supporting table. In other embodiments, the lid from a tray may simply remove and be set down on a lap or table, while the underlying frame or box therebelow forms a holding tray from which items may be removed and placed in the wells during use of the lid as the deck and pillow of the system in accordance with the invention.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 18 is a perspective view of another alternative embodiment in which the top portion or bed comprising a deck and pillow is selective or removable from an underlying tray, to which it may be fastened, hinged, captured by slides, or the like;

FIG. 24 is a perspective view of a partially cut away system in accordance with the invention providing recess storage for a lamp, magnifying glass, or the like;

FIG. 25 is a perspective view of one alternative embodiment similar to that of FIG. 13, and providing a hinged lid for the pillow portion covering a storage tray therebelow, and having selectively attachable pockets, which may be zippered for closure, and may be secured by any suitable means, such as snaps, hook-and-loop fasteners, or the like;

FIG. 29B is a perspective view of the system of FIG. 29A, illustrating the securement of the pillow to the deck, and illustrating storage of materials within the pillow when it is opened, either by the flexibility of the material from which it is formed, by hinges, or the like;

FIG. 60 is a perspective view of an alternative embodiment of a bed in accordance with the invention, this configured to self stabilize against an edge of a tabletop, countertop, or the like.

DETAILED DESCRIPTION OF THE PREFERRED EMBODIMENTS

Figure 1:
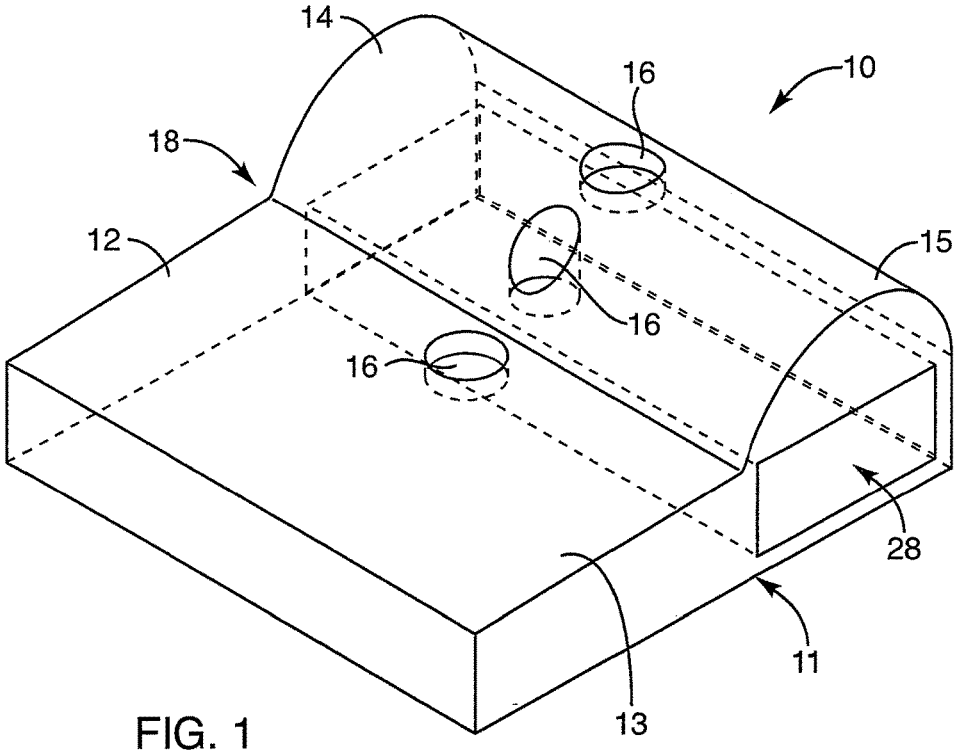
FIG. 1 is an isometric view of one embodiment of an apparatus in accordance with the invention.
Figure 2:
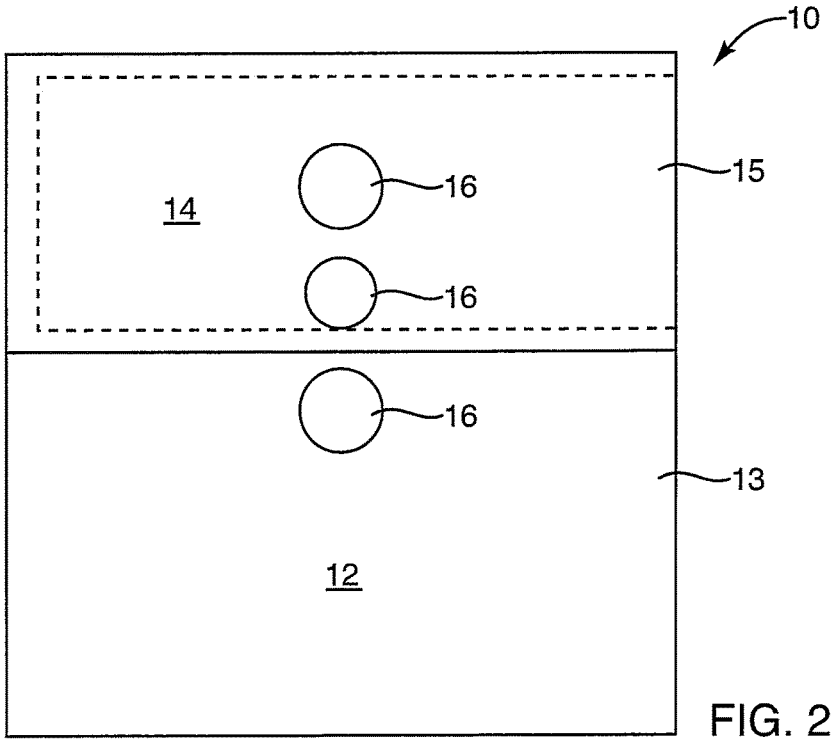
FIG. 2 is a top plan view thereof.
Figure 3:
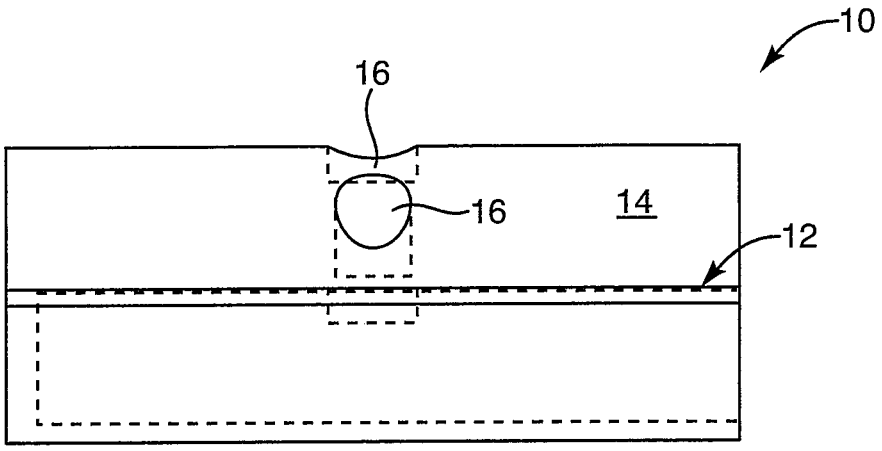
FIG. 3 is a front elevation view thereof.
Figure 4:
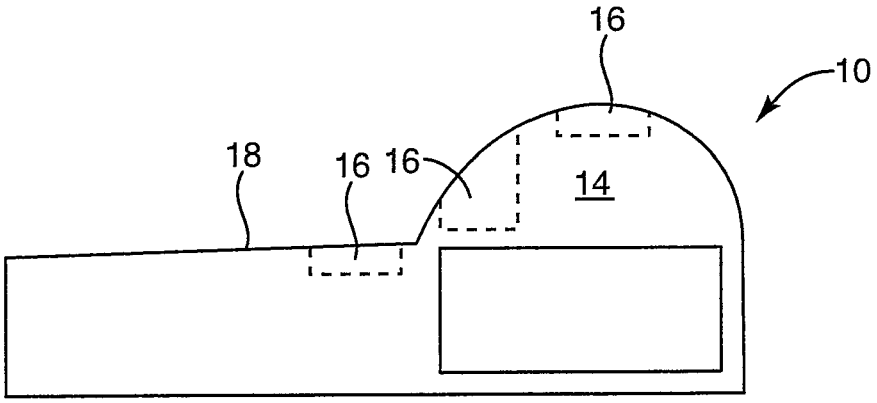
FIG. 4 is a right end elevation view thereof.
Figure 5:
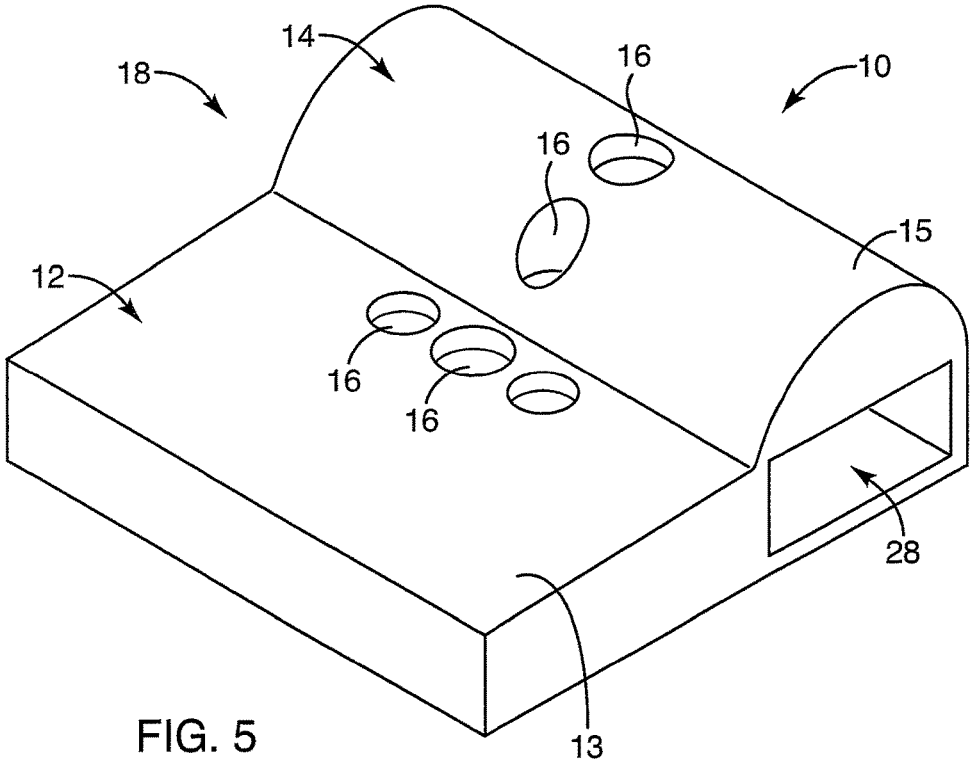
FIG. 5 is an isometric view of an alternative embodiment of an apparatus in accordance with the invention.
Figure 6:
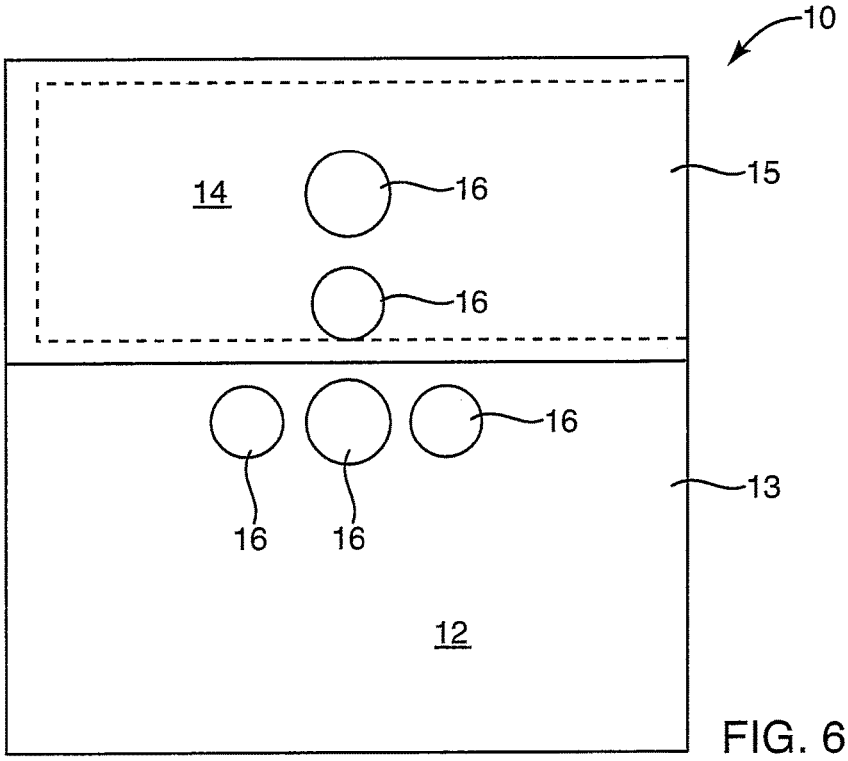
FIG. 6 is a top plan view thereof.
Figure 7:
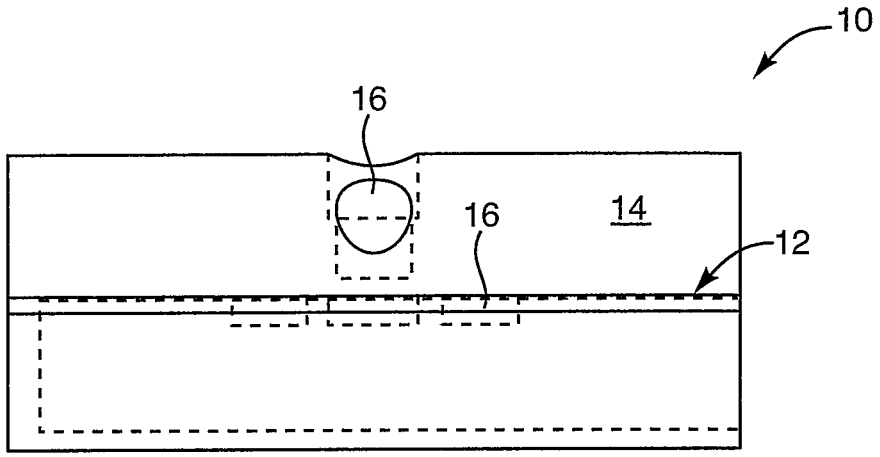
FIG. 7 is a front elevation view thereof.
Figure 8:
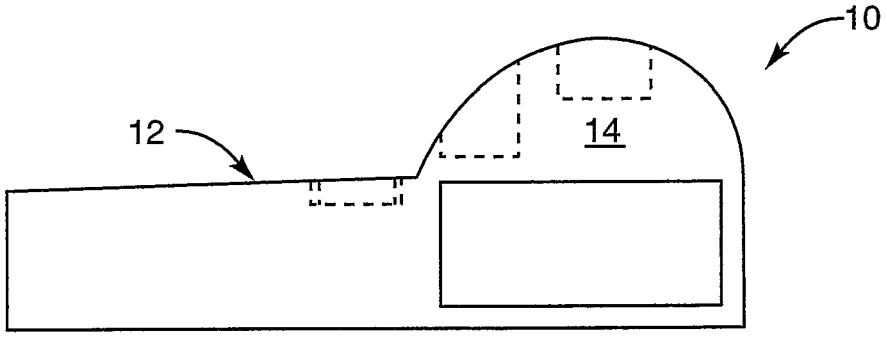
FIG. 8 is a right end elevation view thereof.
Figure 9:
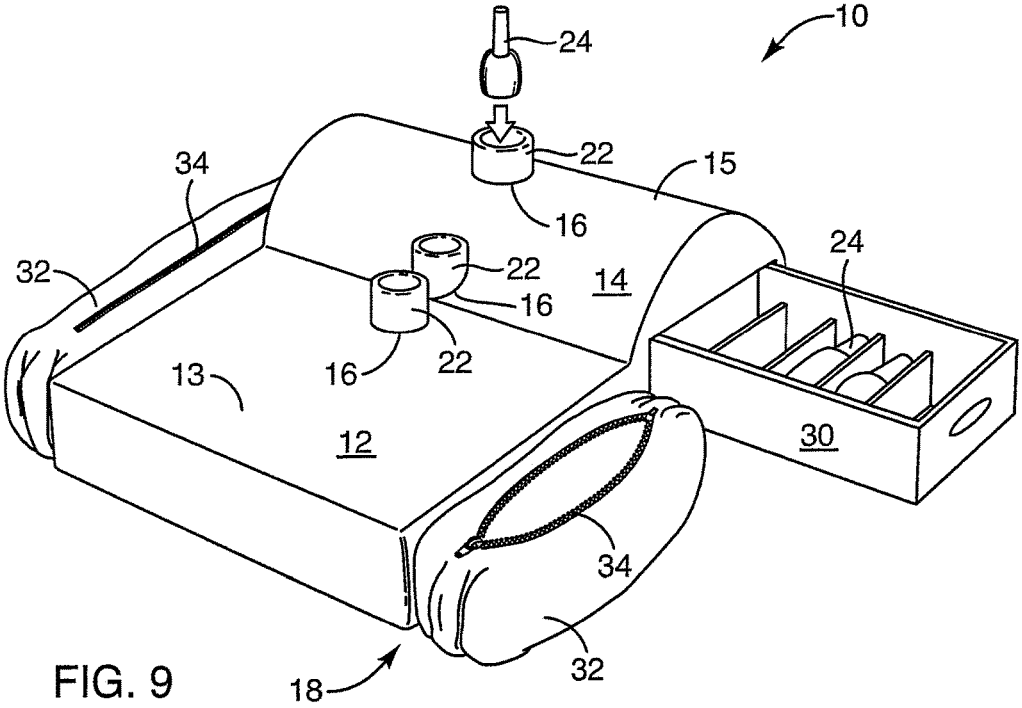
FIG. 9 is a perspective view of one embodiment of an apparatus in accordance with the invention including a drawer or tray stowable within the system, cups extending from and held within the wells in the pillow region and the deck region of the device, and pockets selectively attachable for accessory (tools, equipment) storage.
Figure 10:
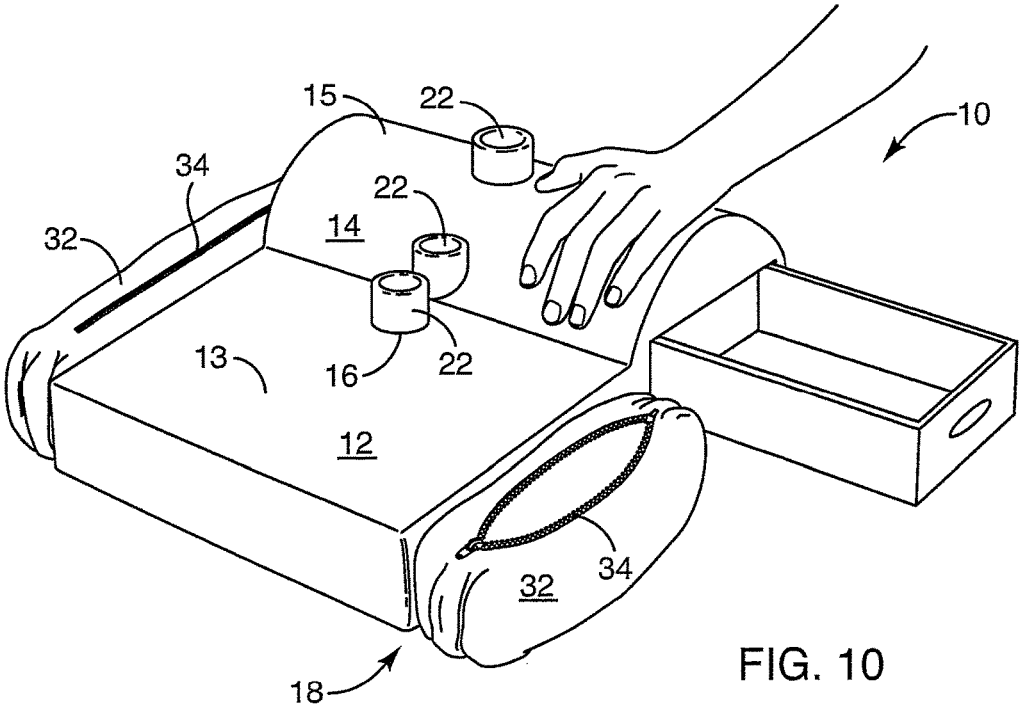
FIG. 10 is a perspective view of the embodiment of FIG. 9 illustrating the hand of a user positioned in a particular arrangement suitable for treatment by another operator on the opposite side of the system.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Referring to FIGS. 1 through 15, a system 10 in accordance with the invention may be formed as a bed 11 or bed 10. However, the system 10 may include only the bed 11, with certain features, or may include many other auxiliary features, components, divisions, and the like. Thus, one may speak of the system 10, as including any or all of those components.

In certain embodiments of an apparatus and method in accordance with the invention, a system 10 may include a bed portion 11 that is made up of a deck 12 or platform 12 having an upper surface 13 on which may rest a hand, foot, fingers, toes, or the like for treatment. Meanwhile, a pillow 14 or pillow portion 14 may be formed as part of the deck 12, or an addition thereto. For example, the deck 12 and pillow 14 may be part and parcel of the same continuous, contiguous, homogeneously molded piece of material. In other embodiments, the pillow 14 may simply be an adjunct that fits on top of the deck 12, and thus forms a rise 14 or pillow 14 above the deck 12. In other embodiments, the deck 12 and pillow 14 may be completely separate articles secured to a common frame, baseboard, underlayment, foundation, tray, or the like.

The pillow 14 also has an upper surface 15 that is conformal to the underlying shape of the pillow 14 in order to present hands, feet, fingers, or toes. This will render them comfortable, visible, and accessible at a proper angle for treatment. By treatment may be included clipping, filing, abrading, softening, pushing or otherwise working or modifying nails, skin, cuticles, or the like.

Thus, the upper surfaces 13, 15 provide various available angles at which a hand of an individual user performing treatments on the hand or foot of that same user (subject) may be rendered visible and accessible for the desired treatment, while also being comfortable. Likewise, the surfaces 13, 15 also provide that a user seated on one side of the system 10 may perform treatments on the hands or feet of another subject on the opposite side of the system 10. Thus, in general, hands may be supported on the deck 12 against the surface 13 thereof, or may be draped over the pillow 14, supported by the surface 15 thereof.

The surfaces 13, 15 may be treated with a coating 20, sealant 20, cover 20, skin 20, or the like in order to protect the underlying bed 11 from damage by solvents in cleaners, removers, polishes, pigments, and so forth. The bulk of the bed 11 may be formed by a body 18 or shaper 18. In certain embodiments, the entire bed 11 may be molded as a single piece of expanded polymeric foam.

The polymeric foam may be any suitable material such as expanded polyethylene, polystyrene, polypropylene, polyurethane, or another material. Elastomeric materials, such as polyurethane have the ability to deflect at a lower elasticity coefficient or elastic modulus. Thus, various densities of foam, with varying stiffnesses may be considered or selected for fabrication of a system 10 in accordance with the invention.

In the body 18 of bed 11 of a system 10, wells 16 may be formed. They may be cut, molded, or otherwise created. For example, hot wire cutting, drilling, die cutting, and the like are all available for cutting foam products. Thus, whether molded in by virtue of cores or other elements, or cut in after molding of the bed 11, wells 16 may be formed of a size and shape suitable, sizes and shapes may be optimized for supporting and holding upright various materials, tools, or the like.

In certain embodiments, cups 22 may be fitted to the wells 16 in order to extend the depth of the wells 16. This may be advantageous, for example, when positioning tools or implements that will be used. For example, it has been found that reaching a tool in a tray or on a surface is very difficult, and typically results in damage to the finish on uncured nails.

If a Q-tip (swab), pad, patch, swatch, stick, tool, or the like is needed to wipe away excess polish from skin, or the like, picking up that article may be problematic. If the article is comparative small in any dimension, and is lying on a horizontal surface, then reaching that object and securing it between a thumb and forefinger or other finger may be impossible without touching a nail to the horizontal surface. Accordingly, the edge of that nail may suffer damage to the uncured finish.

Since nail polishes, for example, are based on solvents and must be cured by evaporation of solvents, a certain period of time occurs in which some of the nails are being treated, while other nails have already been treated and are awaiting cure by drying. For example, an individual may be working on one hand by using the other hand that has already been treated. Alternatively, for example, user may be working on a base layer, a pigment layer, or lacquer layer for a toenail, while the fingernails have already been treated with the same and are curing. Thus, reaching for an implement on a horizontal surface may damage the nails that are in the midst of curing.

Therefore, presenting tools in a substantially vertical orientation may be imperative. To this end, the wells 16 may be provided with cups 22 that extend above the surfaces 13, 15 of the deck 12 and pillow 14, respectively, in order to maintain a vertical orientation. Meanwhile, the cups 22 may have a height or length, which may be also referred to as a depth, that is substantially larger than an effective diameter.

Effective diameter exists for all cross sectional areas. Effective diameter is simply four times the area divided by the wetted perimeter, known as the hydraulic diameter. Thus, the effective diameter of a rectangular cross section is four times the cross sectional area divided by the perimeter. Similarly, a circle or circular cross section has an effective diameter that is the diameter because it is four times the cross sectional area divided by the perimeter or circumference. Different shapes may be determined to have an effective diameter by the same formula. As a practical matter, the effective diameter of a cylindrical cross section or circular cross section is the diameter of the circle. Meanwhile, a square cross section has an effective diameter of the length of a single side.

Thus, the aspect ratio of effective diameter divided by effective depth or length should be a comparatively small number less than 0.5 and typically on the order of 0.25 or less in order to assure a substantially vertical orientation of objects. Of course, the overall total effective diameter may affect the orientation depending on the effective diameter or area of the tool involved. Thus, a long narrow stick may need a longer narrower cup 22 than would, for example, a clipper or nipper that is broader and thereby will stand up without an angle of repose that is too far from vertical to be easily accessible.

Bottles 24 containing material 25, such as polish, solvent, nail polish remover, or other treatments, such as oils, and the like may be stored in some location when not in use. In use, they may be supported in one of the wells 16, directly, or in a cup 22 held securely in a well 16 when needed intermittently during treatment of nails.

Likewise, tools 26 may be of various types, such as clippers 26*a*, emery boards 26*b*, sticks 26*c*, pads 26*d* (such as for applying solvents or rubbing off old polish that has been softened by remover solvents), blocks 26*e*, or the like.

In certain embodiments, a system 10, may include a bed 11 formed as a monolith or a single piece of material thus forming a continuous, contiguous, homogenously molded deck 12 and pillow 14. Nevertheless, the bed 11 may have formed therein an aperture 28 suitable for receiving a drawer 30.

Referring to FIGS. 9 through 28, while continuing to refer generally to FIGS. 1 through 50, one may see that a drawer 30 may be secured within an aperture 28 in a body 18 of a system 10. In the illustrated embodiments, a drawer 30 may be divided to provide storage space for containers 24, such as bottles 24, or the like containing materials, such as polishes, solvents, and the like.

Likewise, pockets 32 may be secured as bags 32 or the like, and may be provided with openings 34, such as zippers 34 for ready closure, for storage. The pockets 32 may be formed to be removable, such as by a suitable fastener. Fasteners may include for example snaps, hook-and-loop fasteners, other zippers, or the like.

Meanwhile, the wells 16 may be oriented in any suitable way. For example, in the embodiment of FIGS. 9 and 10, the wells 16 are arranged such that the maximum dimensions on left and right sides are available. In contrast, in the embodiments of FIGS. 11 through 22, an array of wells 16 distributed left to right occupies space but is readily available, leaving almost the entire width of the pillow 14 or the surface 15 of the pillow 14 available for draping hands thereacross or supporting toes thereon for proper access. Referring to FIGS. 11 through 21, any suitable arrangement may provide for the stability of the wells 16 even when the pillow 14 may be moved or lifted during treatment. Referring to FIG. 22, in the illustrated embodiment, both a lateral array distributed from left to right, and a transverse array distributed forward to backward or proximal to distal are illustrated. Thus, either arrangement or both may be suitable.

Figure 11:
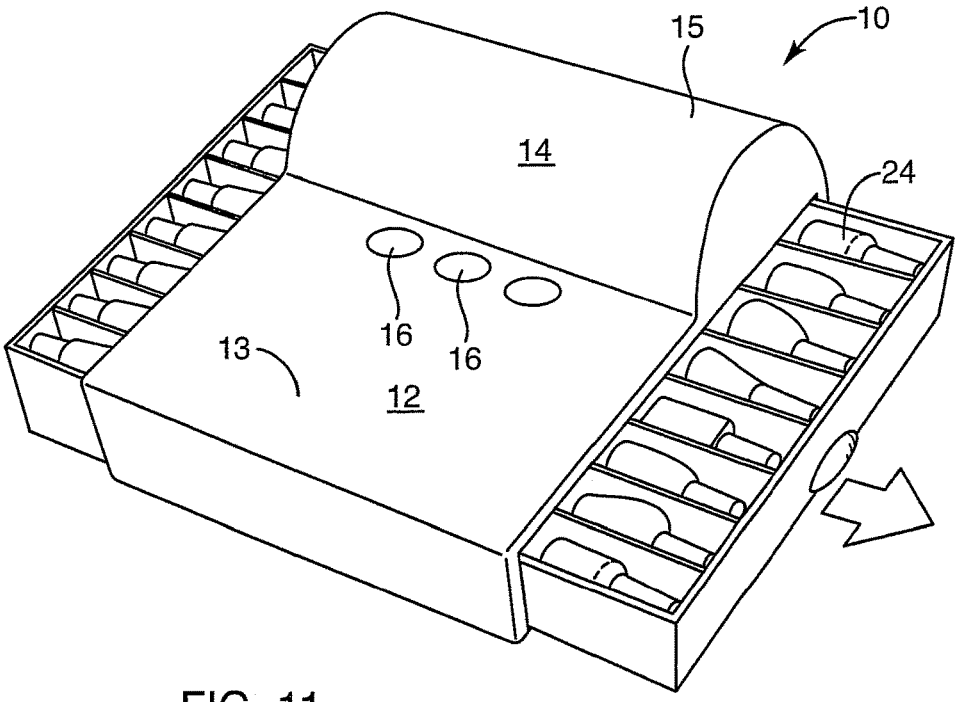
FIG. 11 is a perspective view of one embodiment of an apparatus in accordance with the invention and including a base portion having drawers or trays selectively openable and closable for storage of materials and equipment.
Figure 12:
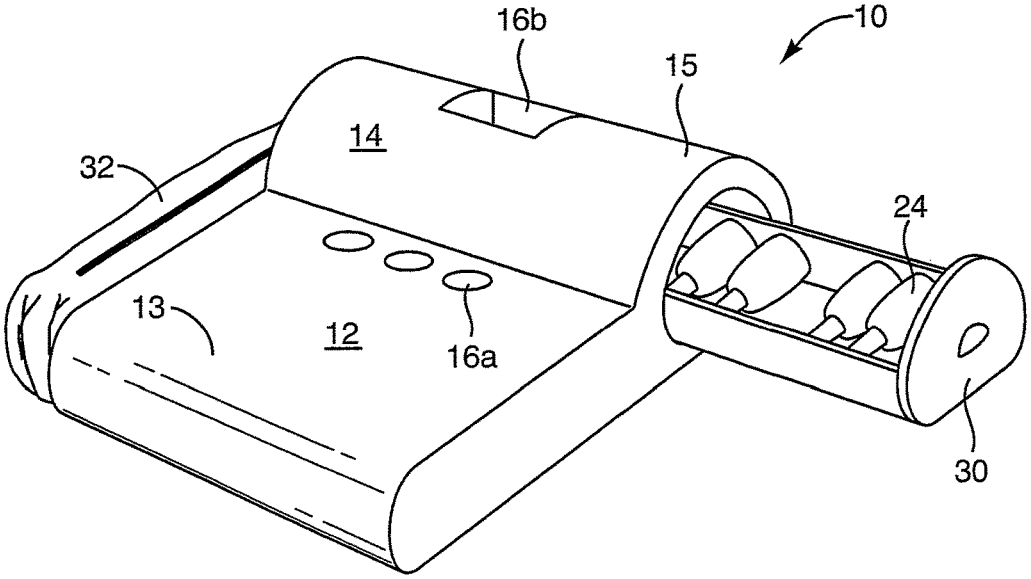
FIG. 12 is a perspective view of an alternative embodiment having a tray that withdraws from within the pillow portion, and the pillow portion also having an accessory holder while the polish holders or wells for materials are in the deck portion, and an accessory pocket for storage is also selectively attachable to the end thereof.

Referring to FIG. 11, in certain embodiments, multiple drawers 30 may be available and may be withdrawn from left side, right side, front, rear or the like. Referring to FIG. 12, the drawer 30 may actually be embedded entirely within the pillow 14. Meanwhile, wells 16 for bottles 24 may be formed in the deck 12, while a deeper well 16 may be available as an accessory holder or well 16*b* in the pillow 14, rather than in the deck 12 as the well 16*a*.

Figure 13:
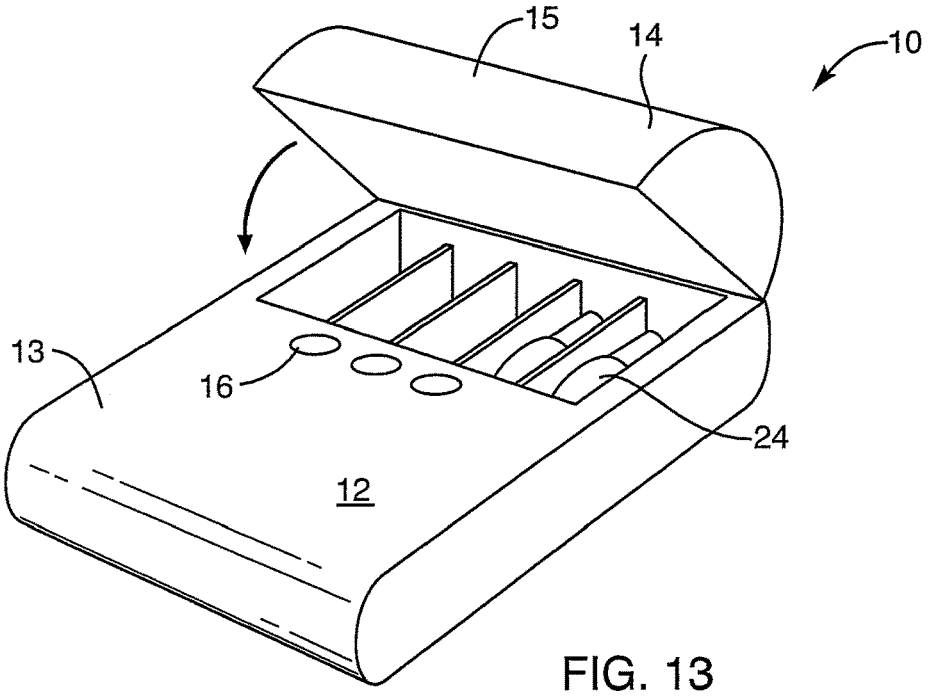
FIG. 13 is a perspective view of an alternative embodiment in which the pillow portion rises as a hinged lid to cover a storage tray for materials, tools, or the like, and wells are formed within the deck portion.

Referring to FIG. 13, a hinge may provide for a separate pillow 14 that may be hinged to lift up from and then be positioned to rest again back on the deck 12. Thus, a region supporting containers 24 may be available for permanent storage under the pillow 14, while the wells 16 are available during treatment of nails.

Figure 14:
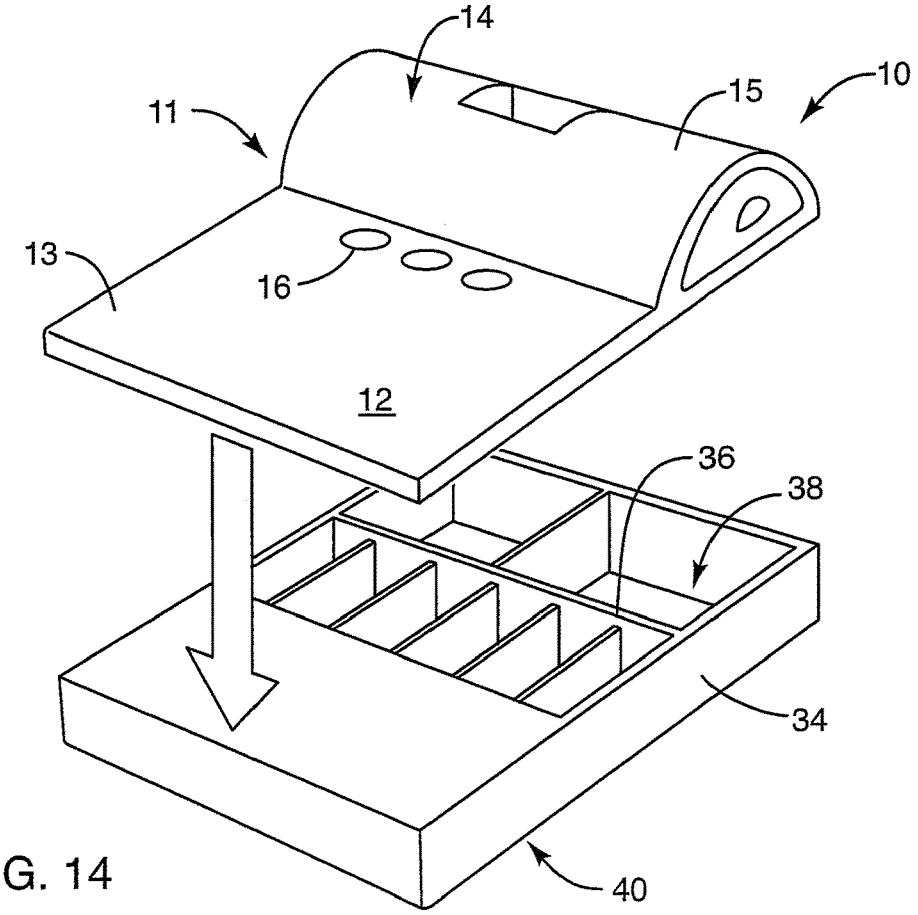
FIG. 14 is a is a perspective view of an alternative embodiment having a base portion from which the deck and pillow are selectively removable.

Referring to FIG. 14, the entire top of a system 10 may actually form the bed 11 which may be separable from a lower tray 34. In fact, the tray 34 may be provided with dividers 36 establishing compartments 38 for storing materials such as containers 24, tools 26, and the like. However, a base 40 may be integrated as part and parcel to the bed 11, or may be completely separable as in FIG. 14, where the bed 11 simply forms the lid 11 of a base 40, and the base 40 is a tray 34 with multiple divisions of compartments 38 therein.

Figure 15:
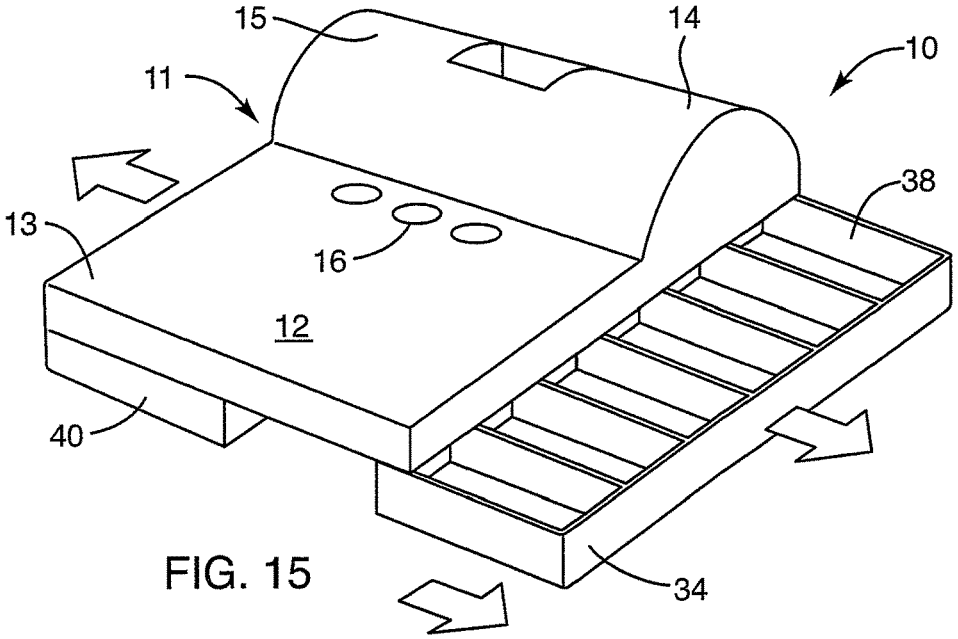
FIG. 15 is a perspective view of an alternative embodiment in which the base slides from underneath the deck and pillow support portion.
Figure 16:
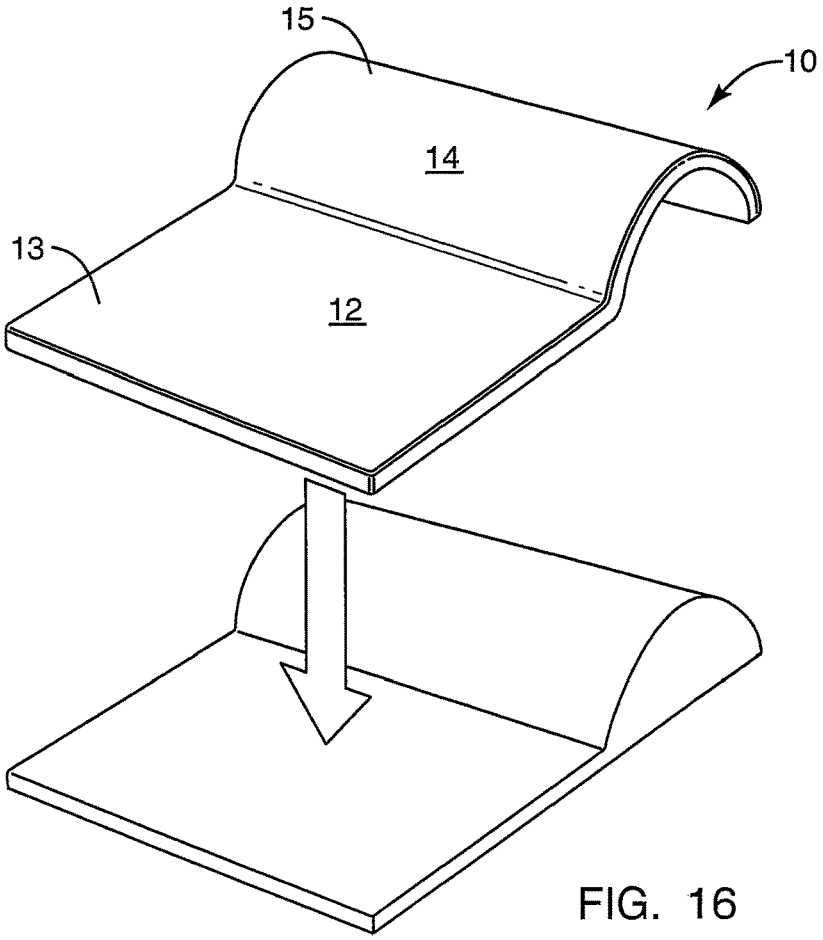
FIG. 16 illustrates an alternative embodiment in which an underlying frame may be formed of sheet, such as a sheet metal, sheet plastic, or the like of a comparatively rigid confirmation covered by a foam cover that forms the bed of a deck and pillow.

Referring to FIG. 15 and FIG. 16, in certain embodiments, a portion of the base 40 may simply slide out from under the bed 11, thus forming a tray 34 of divided compartments 38.

Figure 17:
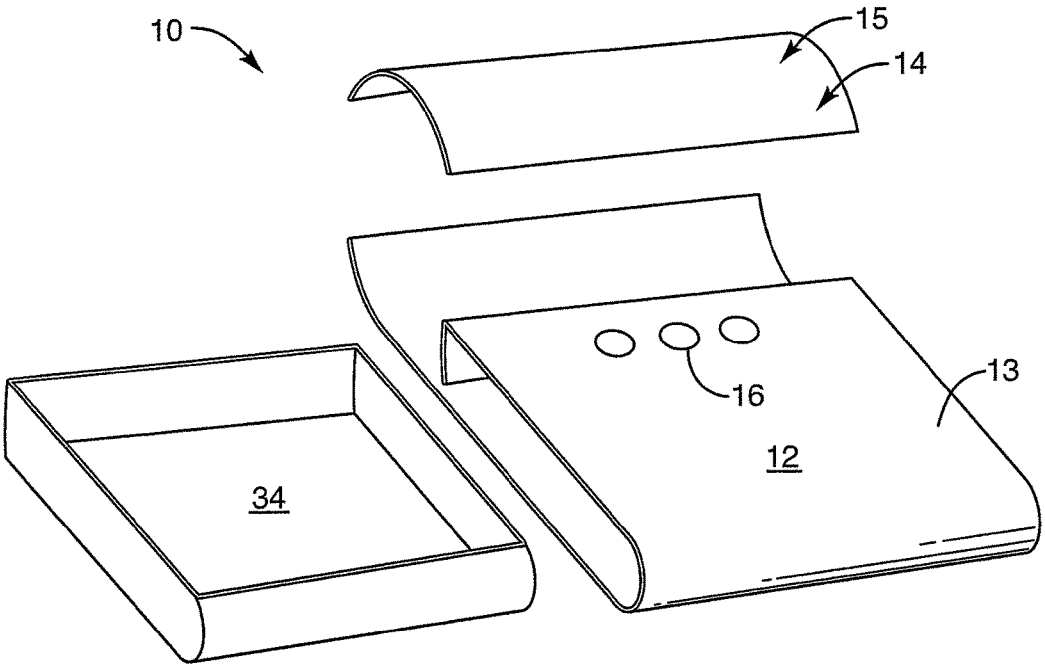
FIG. 17 is a perspective view of an alternative embodiment in which a base tray fits within a wrap that forms the bed having a deck and pillow portion.

Referring to FIG. 17, a tray 34 may simply slide into a deck 12. In this embodiment, the deck 12 may be largely hollow, or even may be wrapped around the tray 34 which may form more of the structural support therefor.

Figure 18:
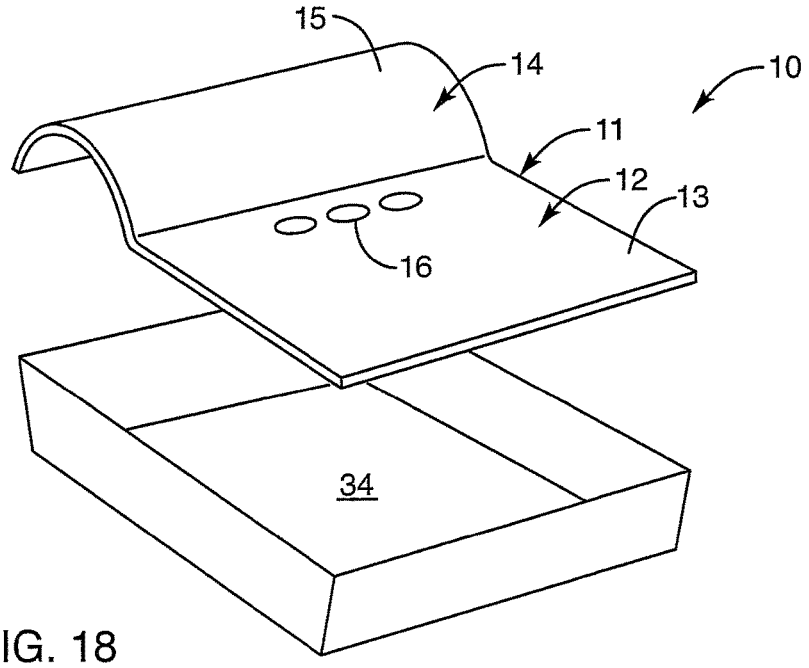

Referring to FIG. 18, the bed 11 may simply be a comparatively thinner deck 12 and pillow 14 hinged, connected by sliding connectors, or otherwise fastened to secure to a tray 34 during use of the bed 11, or at a different time. For example, a comparatively stiffer under layer may form the basis of the bed 11. The surfaces 13, 15 may be formed by a softer material, such as a fabric, foam, fabric, covered foam, sealed foam, skinned foam, or the like. Meanwhile, the tray 34 may be left as a support for positioning the bed 11 thereabove, or may be removed during use, at which point the tray 34 is not needed as the entire bed 11 if formed by the comparatively thinner structure with a softened upper surface material.

Figure 19:
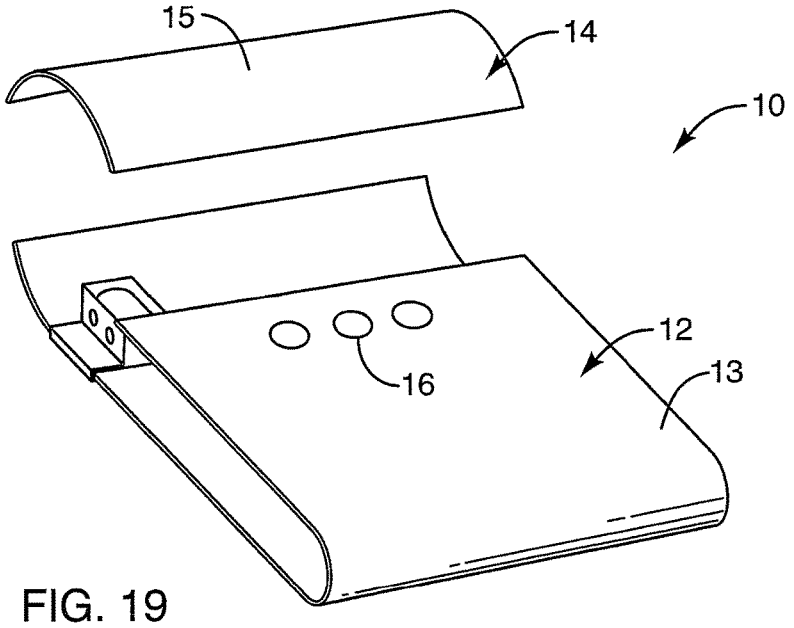
FIG. 19 is a perspective view of an alternative embodiment, illustrating storage space underneath the upper portion of the pillow portion of the bed.

Referring to FIG. 19, in certain embodiments, the system 10 may be embodied as layers. These may snap together, open, separate, and the like in order to form the pillow 14, the deck 12. They may include storage contained therein.

Figure 20:
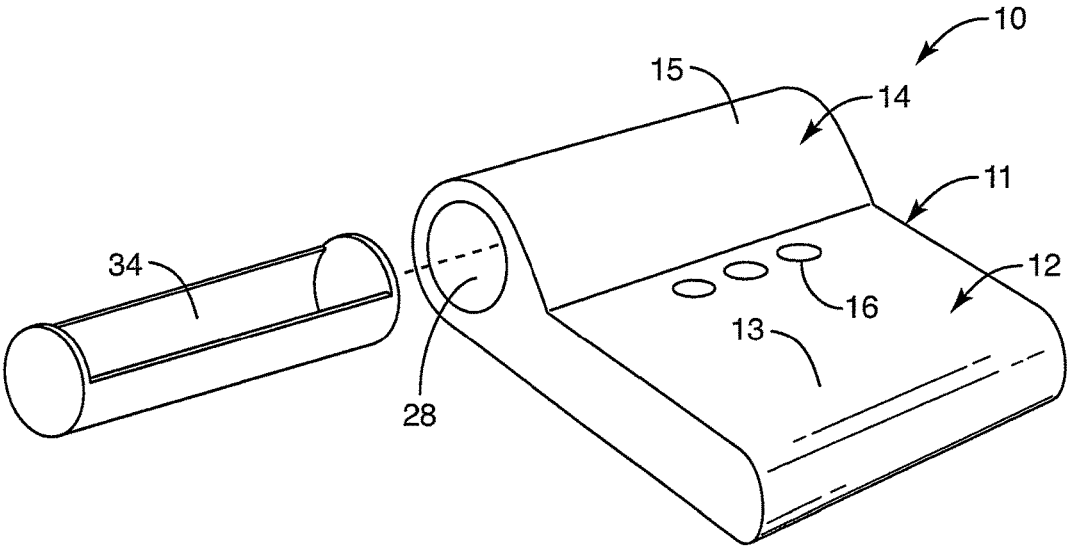
FIG. 20 is a perspective view of an alternative embodiment in which a drawer or slide is removable from the pillow, and conforms to the more-or-less oval cross sectional shape thereof.

Referring to FIG. 20, the shape of the pillow 14 may adapt itself to an aperture 28 that will receive a tray 34 therein. In such an embodiment, the entire bed 11 may be formed of a single continuous, contiguous, homogeneously molded piece of foam, which may be shaped by cutting, molding, or the like. Meanwhile, an aperture 28 that is circular, oval, or otherwise adapted to the shape of the bed 11 and, specifically, the pillow 14, may be fabricated to receive a suitable tray 34 for storage.

Figure 21:
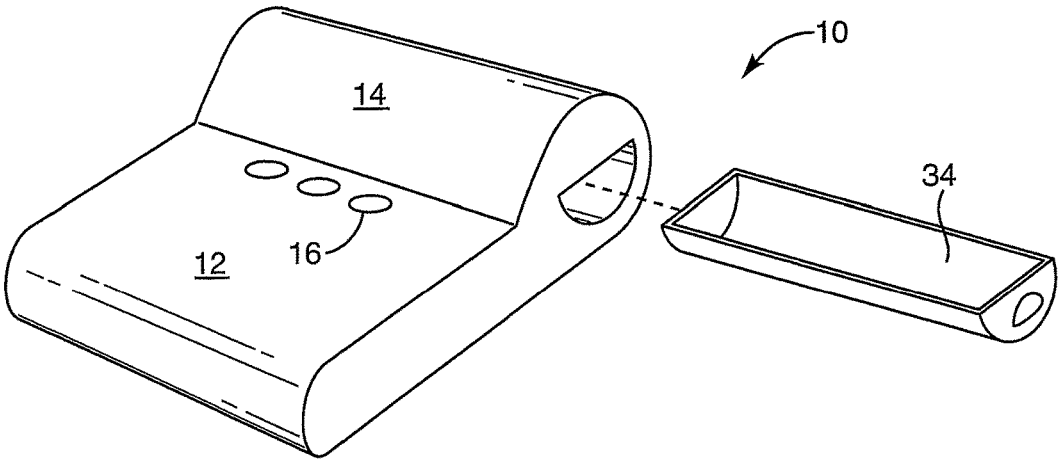
FIG. 21 is a perspective view of an alternative embodiment in which a semicircular cross section for a tray is formed to fit within the pillow portion of the system.
Figure 22:
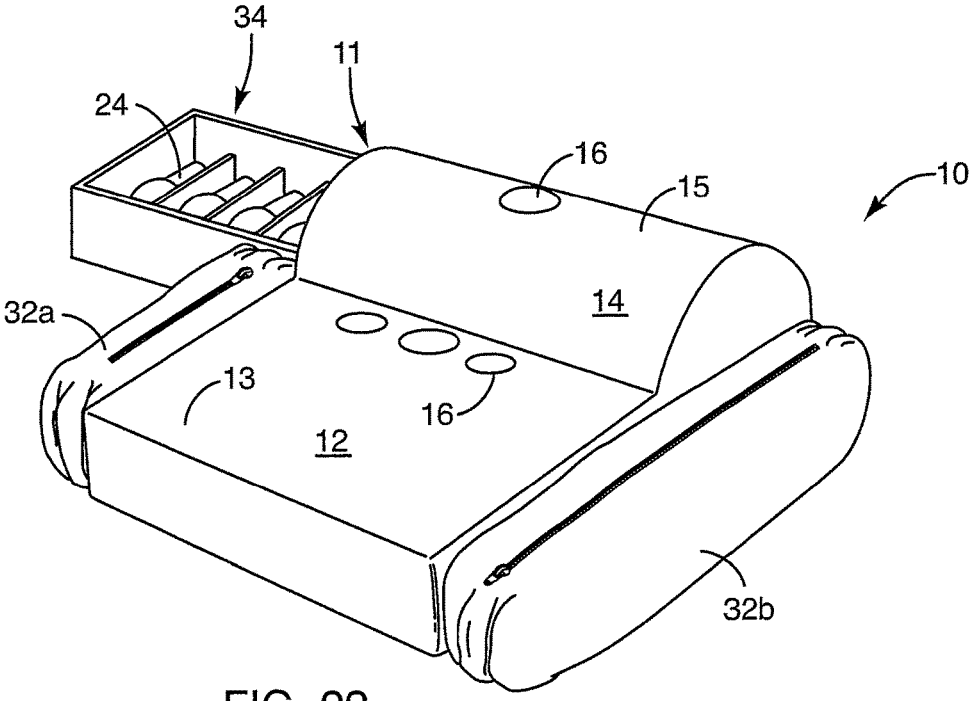
FIG. 22 is a perspective view of an alternative embodiment similar to that of FIGS. 9 and 10 having selectively attachable and detachable storage pockets zippered and appointed with fasteners.

Referring to FIG. 21, other embodiments, such as a semicircular tray 34 may be adapted to fit within the pillow 14 or other portion of the system 10. Meanwhile, the deck 12 also forms a lid providing access to the space underneath the deck 12.

Figure 23:
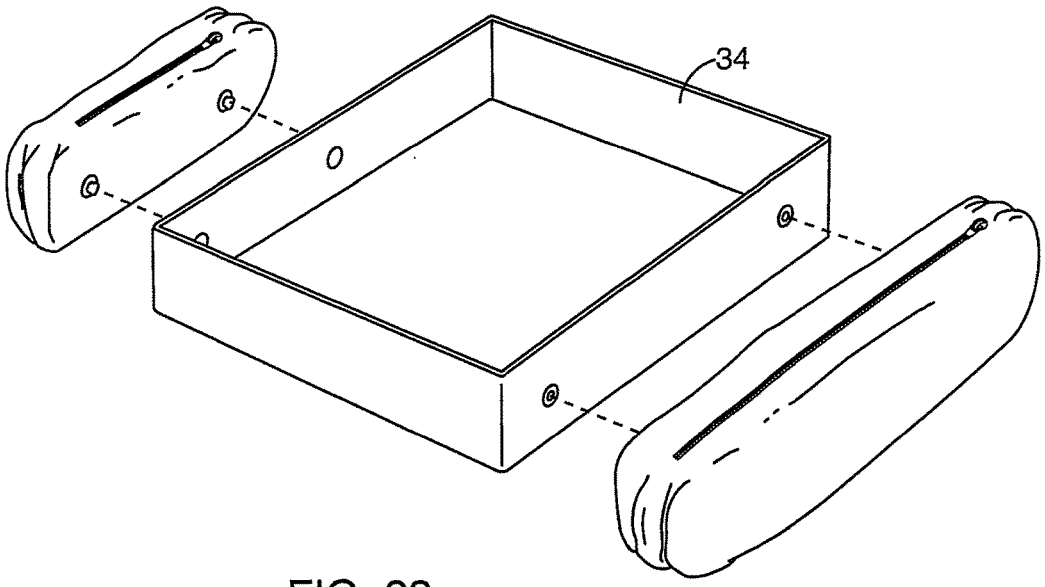
FIG. 23 is a perspective view of one embodiment of a tray that may form a base for an apparatus such as that of FIG. 22 in an alternative embodiment, which may be hinged, connected by slide keepers, or fit as an inside box with the bed forming the cover of that box during storage, use, or both.

Referring to FIGS. 22 through 23, a comparatively shorter pocket 32*a* may be formed to fit opposite a longer pocket 32*b*. The pocket 32*a* does not cover the access to a tray 34 that may need to be withdrawn from within the pillow 14. Meanwhile, this embodiment also illustrates orientations of both lateral and transverse alignments for the wells 16. In certain embodiments, FIG. 23 may be built within the bed 11, or may be an alternative embodiment in which the deck 12 and pillow 14 simply fit over the top of the tray 34 of FIG. 23 like a box top over a box.

Figure 24:
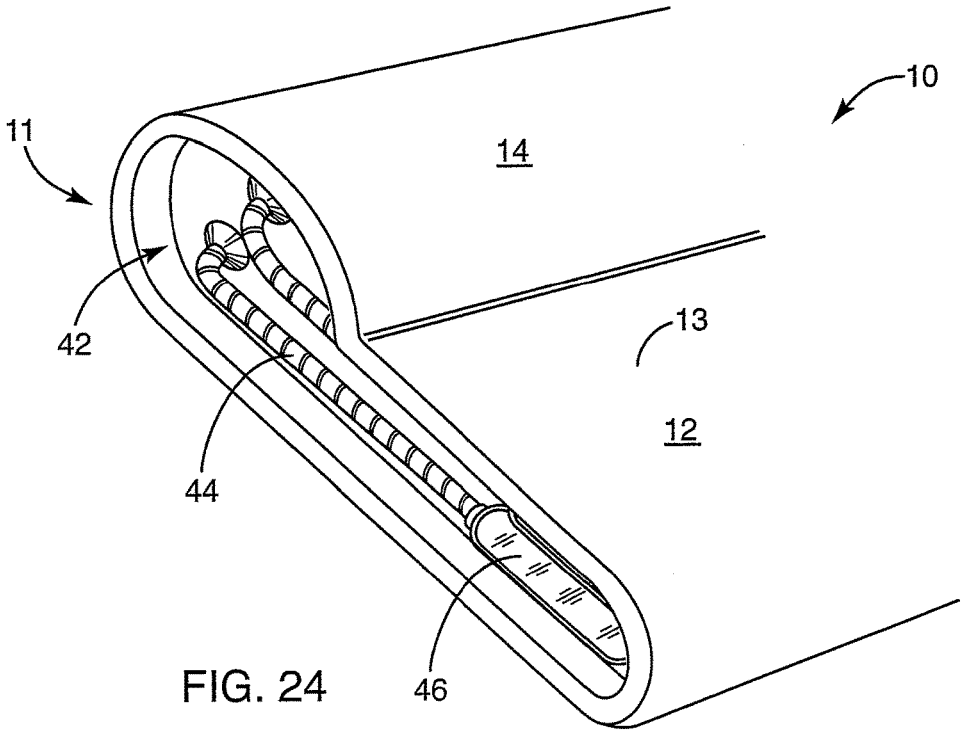

Referring to FIG. 24, in certain embodiments, a recess 42 may be formed in one end of the bed 11. A pedestal 44 supporting, for example, a light 46 may be stowed there.

Figure 25:
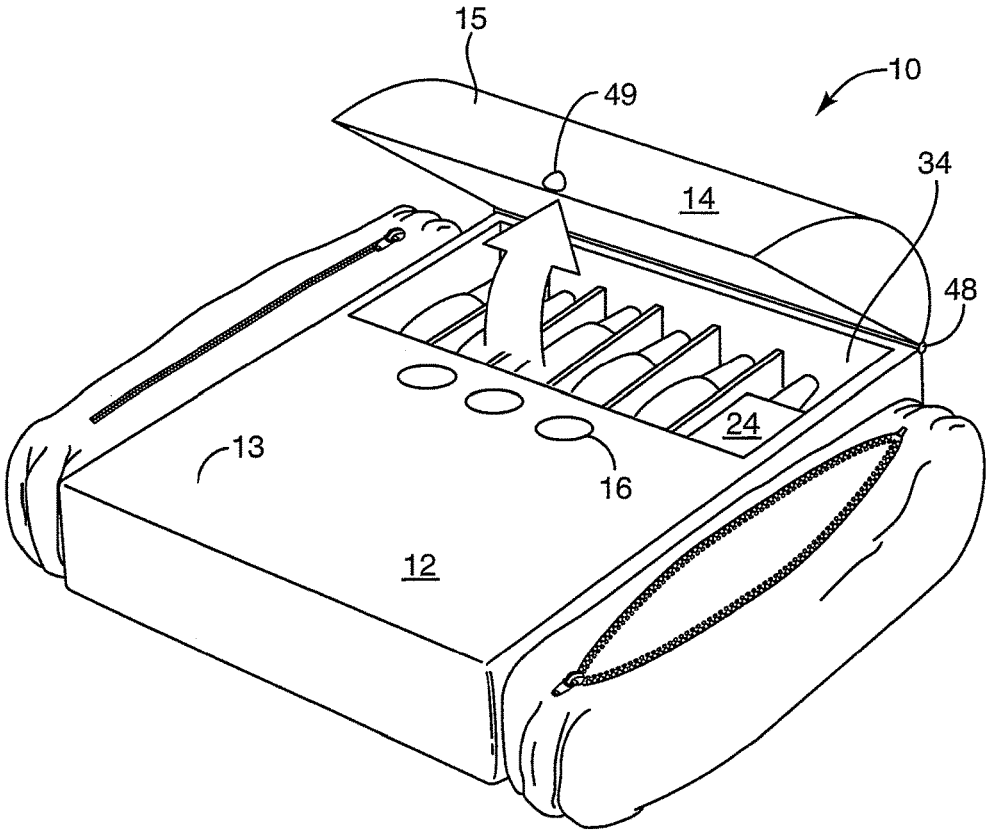

Referring to FIG. 25, a hinge 48 may form a securement mechanism for tilting a pillow 14 above the deck 12, to expose an underlying tray 34 storing containers 24 of materials. Meanwhile, securement mechanism 49, such as a latch, pin, button, fastener, snap, or the like may be used to secure the pillow 14 down against the deck 12. For example, during use, gravity will perform the function, and hands or feet may be resting on the deck 12, the pillow 14, or both. Thus, maintaining the pillow 14 in its closed position should not be difficult during activities. However, for permanent storage, it may be advisable to have a latch 49 or other fastener 49 in order to assure securement and closure of the tray 34.

Figure 26:
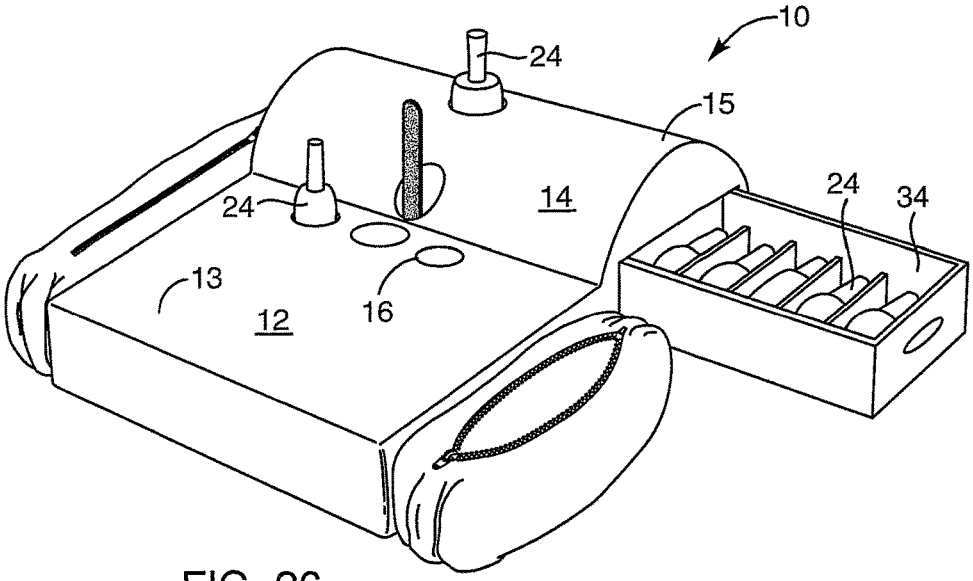
FIG. 26 is a perspective view of an alternative embodiment similar to that of FIGS. 9 and 10, and illustrating use of the wells for storage of bottles of material, tools for vertical orientation and easy access, and so forth.

Referring to FIG. 26, the alternative to a hinge 48 may be the tray 34 operating as a drawer 34. Again, the wells 16 may be in the transverse orientation, the lateral orientation, or both in a single system 10.

Figure 27:
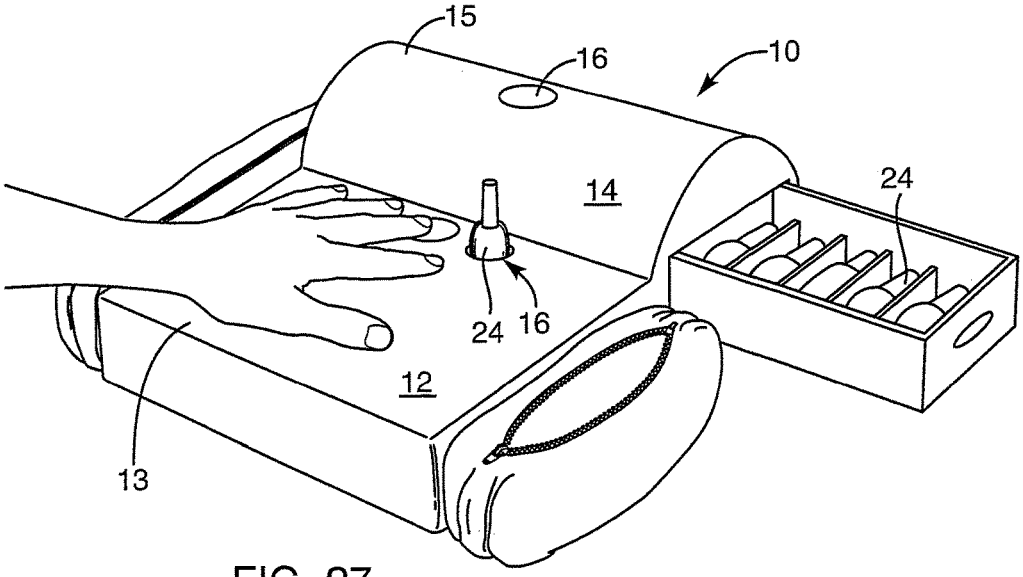
FIG. 27 is a perspective view of the apparatus of FIG. 26 in one mode of use in which the hand of a subject is rested on the deck portion of the bed.

Referring to FIG. 27, a hand may rest for treatment, or for waiting during cure on the deck 12. Similarly, a hand may be draped over the pillow 14. Either orientation may be suitable or different purposes, also depending on whether a user is treating his or her own hands or feet, or those of another.

Figure 28:
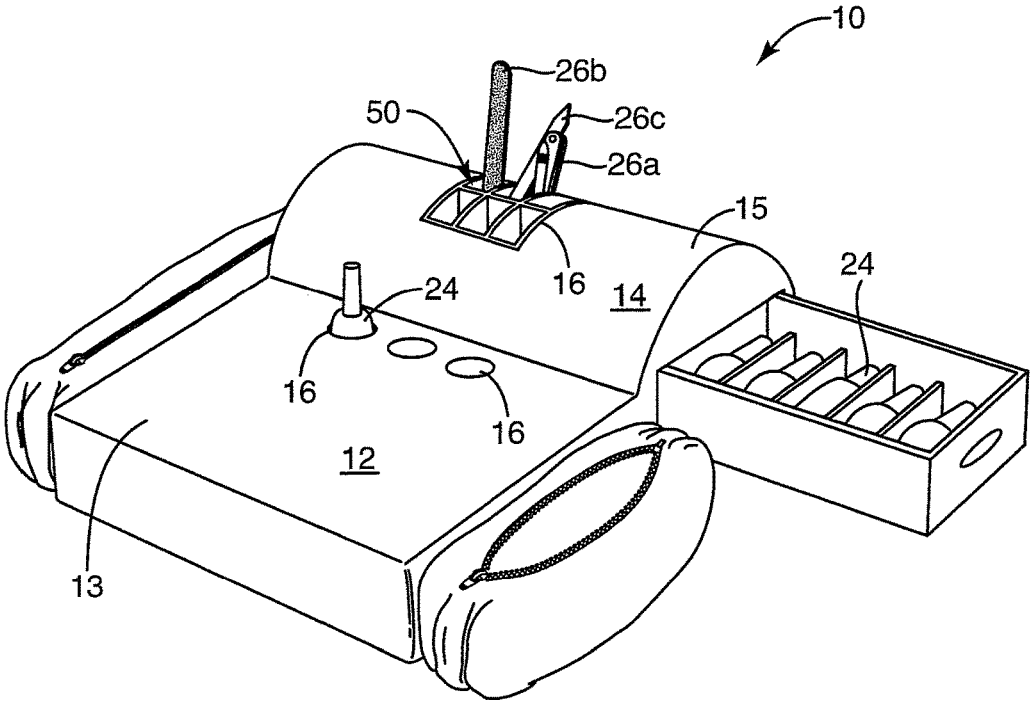
FIG. 28 is a perspective view of an alternative embodiment showing additional storage mechanisms, such as a compartmentalized accessory holder inserted into a cavity or well within the pillow.

Referring to FIG. 28, a divided compartment 50 may fit within a well 16 within the pillow 14. Thus, any suitable depth, other dimensions, and the like may be selected and formed in the compartment 50 that itself has sub-compartments.

Figure 29A:
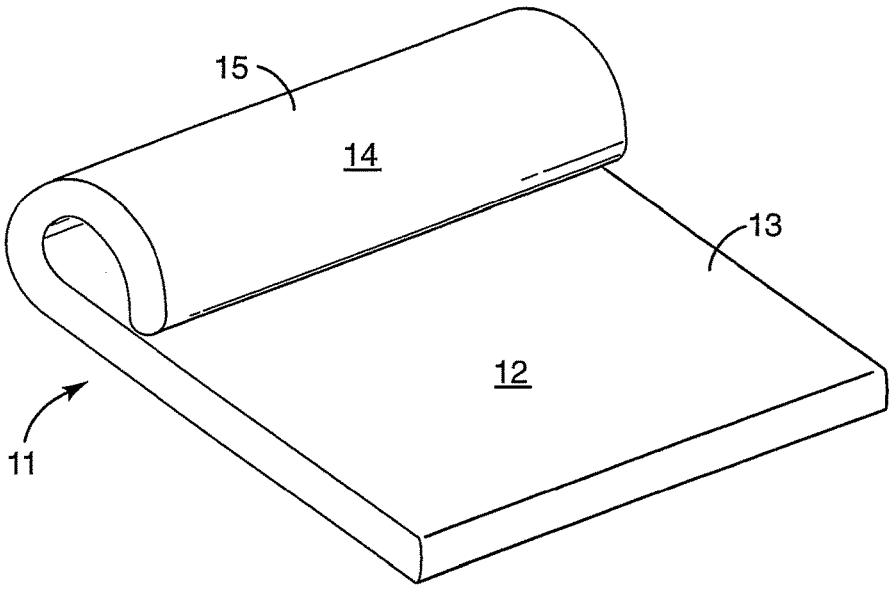
FIG. 29A is a perspective view of an alternative embodiment that rolls open.
Figure 29B:
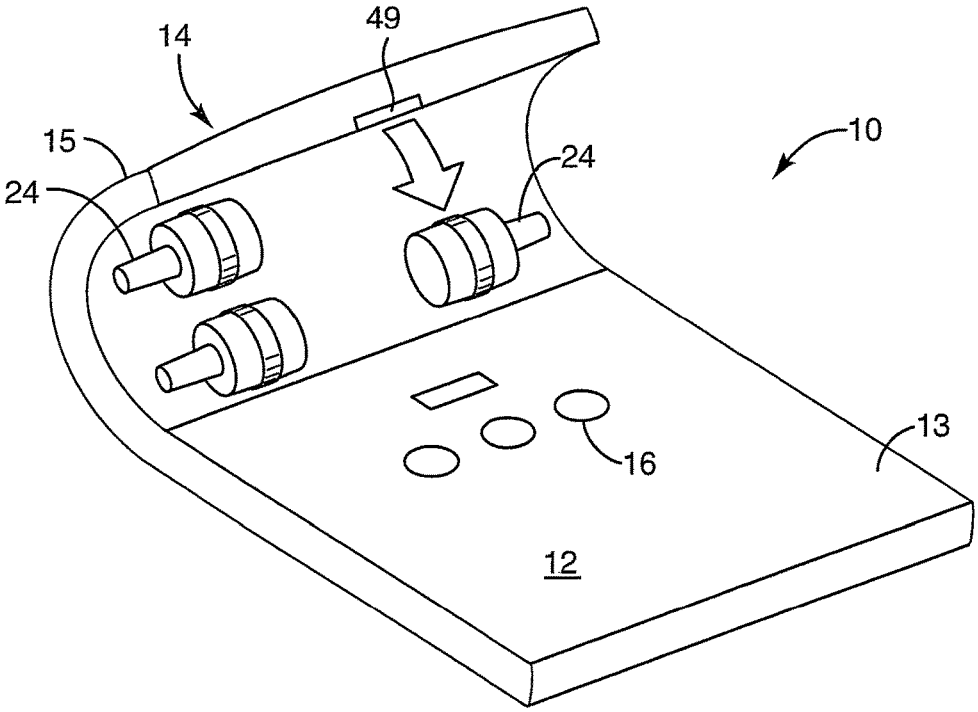

Referring to FIGS. 29A and 29B, in certain embodiments, the bed 11 may simply roll up for stowage. In such an embodiment, a fastener 49 may secure the pillow 14 to the deck 12 during use. Meanwhile, the stowed containers 24 may be withdrawn and placed in the wells 16 for use. Thus, the entire deck 12 may actually wrap around the pillow 14 for stowage. Meanwhile, a comparatively thinner, on the order of half an inch to perhaps an inch of foam may form the deck 12 and the pillow 14 with a single contiguous piece.

Figure 30:
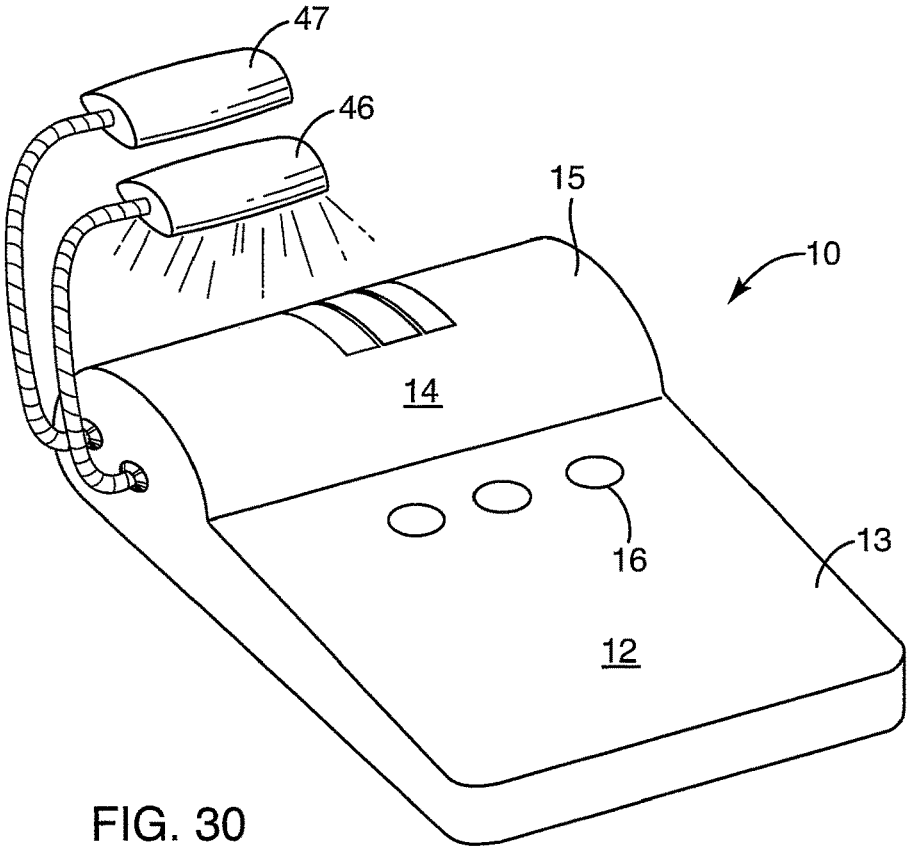
FIG. 30 is a perspective view of one embodiment of an apparatus having compartmentalized storage for tools embedded in the pillow, wells for storage of materials such as polishes in the deck portion, and a light, magnifying glass and associated supports for illuminating the nails of a subject, and for obtaining a close-up magnifying view thereof.
Figure 31:
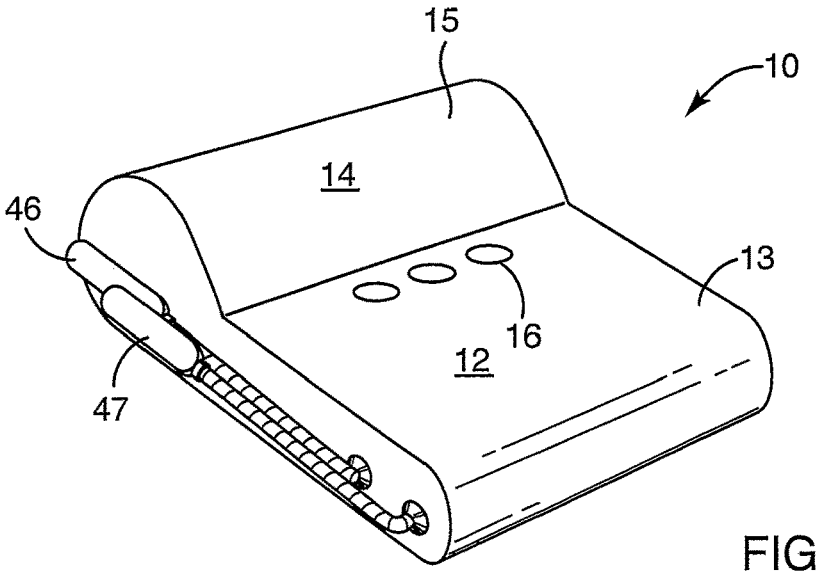
FIG. 31 is a perspective view of an alternative embodiment in which a lamp, magnifying glass, or the like may be secured near the proximal edge of the deck, thus providing more storage space near the higher pillow portion thereof.

Referring to FIGS. 30 through 31, a lamp 46 and magnifying glass 47 may be connected, temporarily, permanently, or selectively to a system 10 in order to illuminate the nails on which a subject is working. Meanwhile, as illustrated in FIG. 31, the lamp 46 and glass 47 may be connected to the opposite (in this case, the proximal) end of the system 10 for a better match of the storage space corresponding to the cross section of the pillow 14.

Figure 32:
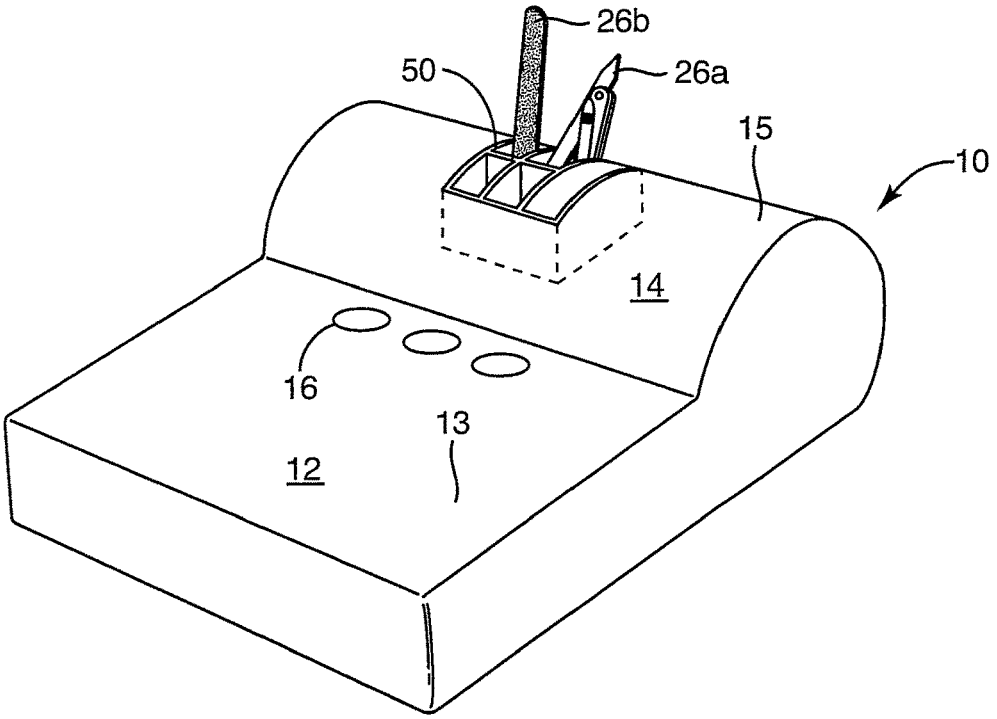
FIG. 32 is a partially cut away perspective view of a detail of a compartmentalized storage space in the pillow holding various tools, such as clippers, emery boards, and so forth.
Figure 33:
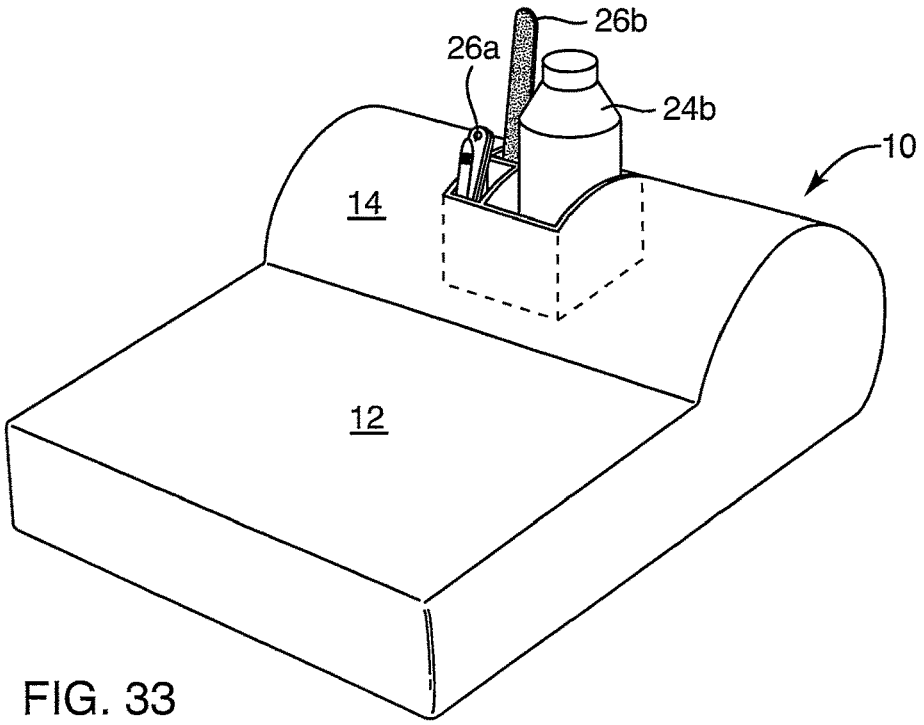
FIG. 33 is a perspective view of an alternative arrangement providing storage for a bottle, such as nail solvent.

Referring to FIGS. 32 and 33, the compartment 50 inserted into the pillow 14 may be of any suitable shape, and depth. For example, space for a solvent bottle such as the bottle 24*b* may be included in certain embodiments.

Figure 34:
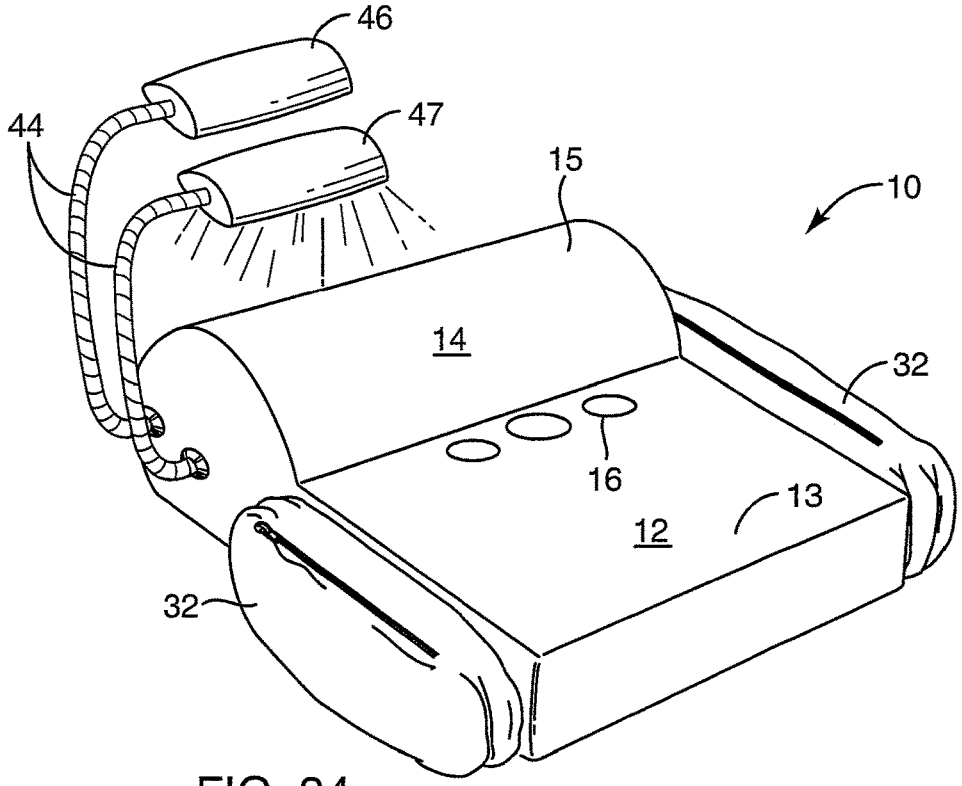
FIG. 34 is a perspective view of an alternative embodiment showing magnifying glass, and the like with selectively attachable side pockets for storage.

Referring to FIG. 34, a light 46 and magnifying glass 47 may also be combined with removable side pockets 32. The pockets 32 may cover the pedestals 44 and the light 46 as well as the magnifying glass 47 when stowed, but may be removed to expose them for deployment.

Figure 35A:
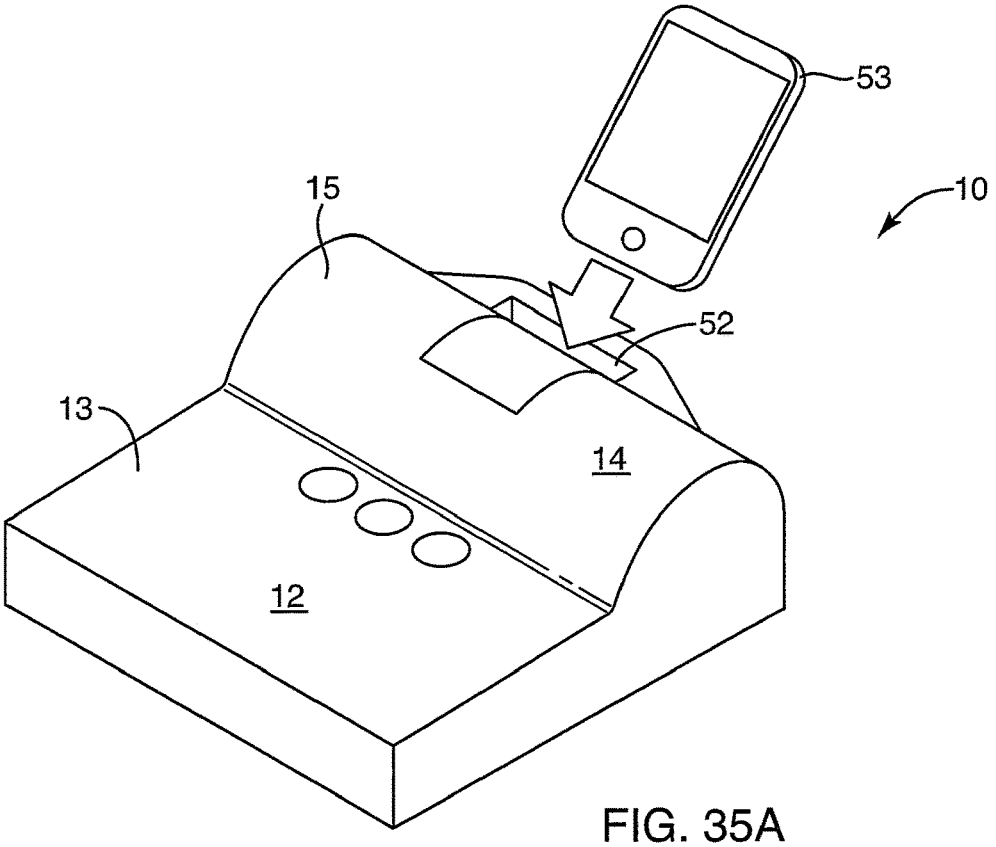
FIG. 35A is a perspective view of an alternative embodiment of an apparatus in accordance with the invention provided with a docking station for a phone.
Figure 35B:
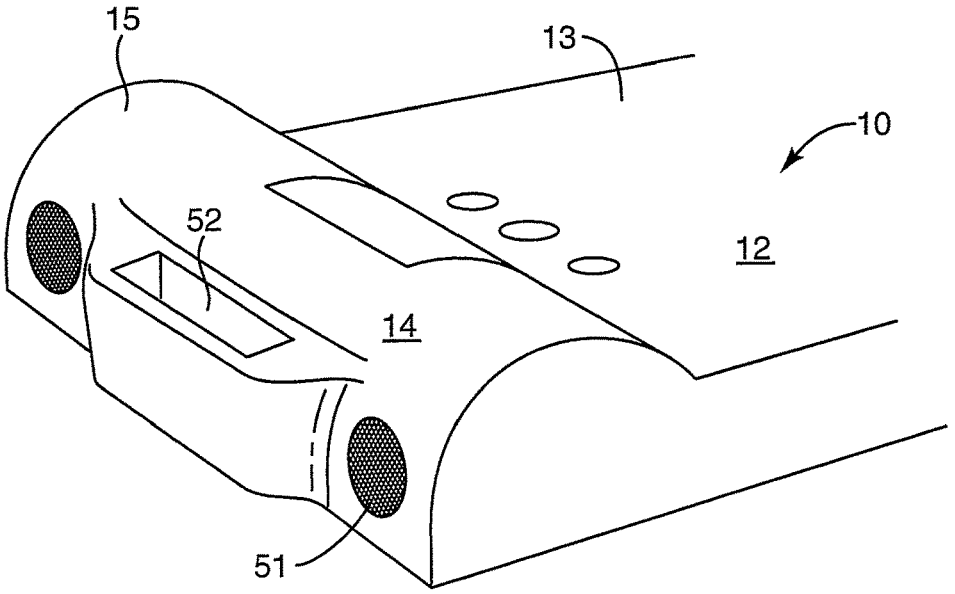
FIG. 35B is a partially cut away rear perspective view thereof.
Figure 36:
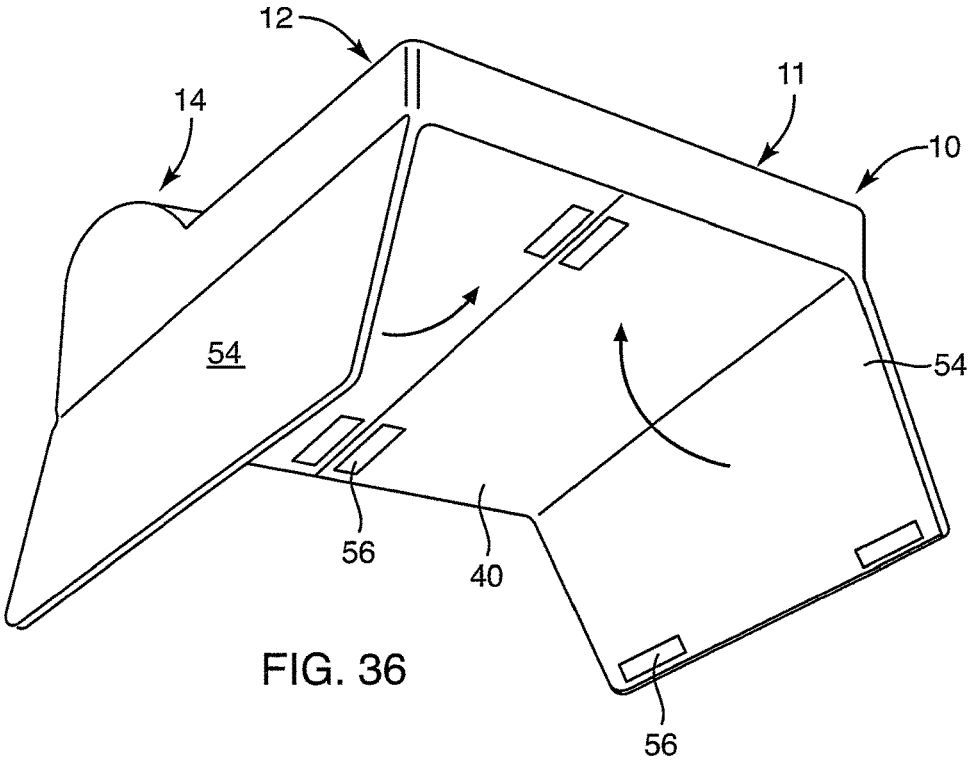
FIG. 36 is a perspective view of the underside of an alternative embodiment in accordance with the invention, this having wings that fold down to form legs hinged against the base board of an apparatus in accordance with the invention.
Figure 37:
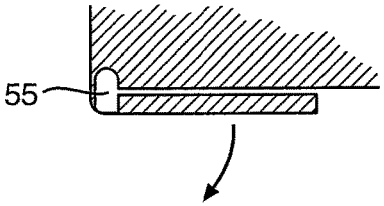
FIG. 37 is an end view of partially cut away illustrating the hinge and positioning of the wing of FIG. 36.
Figure 38:
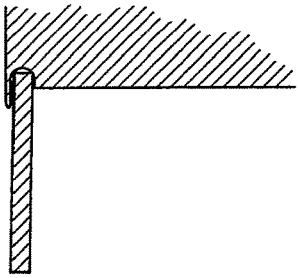
FIG. 38 illustrates an alternative embodiment with the wings as "legs" in a deployed position.
Figure 39:
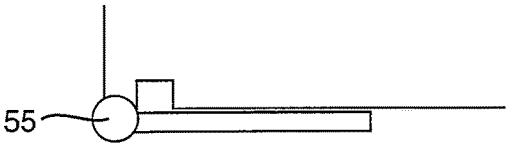
FIG. 39 is an end elevation view of an alternative embodiment of a hinged wing operating as a deployable and storable leg portion of an apparatus in accordance with the invention.

Referring to FIGS. 35A through 35B, a dock 52 may be provided for a phone 53. If batteries and a power supply are available, then speakers 51 may actually be embedded within the system 10.

Referring to FIGS. 36 through 39, a bed 11 may have associated with it wings 54 that may be selectively opened and closed to operate as legs 54. For example, in the illustrated embodiment, hinges 55 may provide for deployment, and fasteners 56, such as hook-and-loop fasteners 56 may be used to secure the wings 54 in their stowed position flat against the base 40 of the bed 11.

Figure 40:
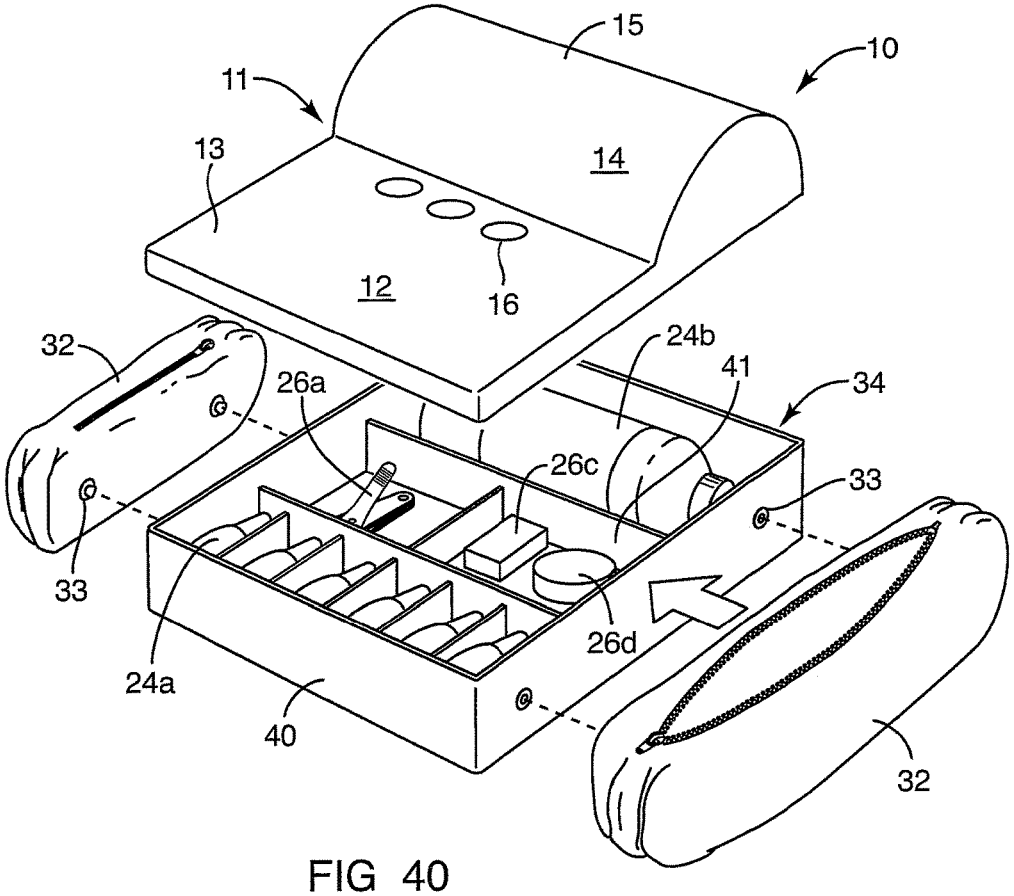
FIG. 40 is an exploded perspective view of an alternative embodiment of an apparatus in accordance with the invention, this having a top that forms the bed with its associated deck and pillow, which may be used while attached to a base tray or box, or which may be used separately from the box, while the box remains open and available for accessing stored products, materials, tools, and so forth, and provided with optional storage pockets removable therefrom.

Referring to FIG. 40, the base 40 may actually serve as a tray 34 containing the various containers 24*a*, 24*b*. Meanwhile, various tools 26*a*, 26*b* such as clippers 26*a*, pads 26*d*, wedges 26*e* or blocks 26*e*, and the like may be stored in the various compartments. Meanwhile, the entire bed 11 may operate as a lid 11 removable for use, or left on the base 40 for use. In the illustrated embodiment, the fasteners 56 may be buttons, snaps, hook-and-loop fasteners 56, or the like. Thus, the selectively attachable and removable pockets 32 or bags 32 may be integrated for storage and hauling, but may be removed if desired for setting up for treatment of hands or feet.

Figure 41:
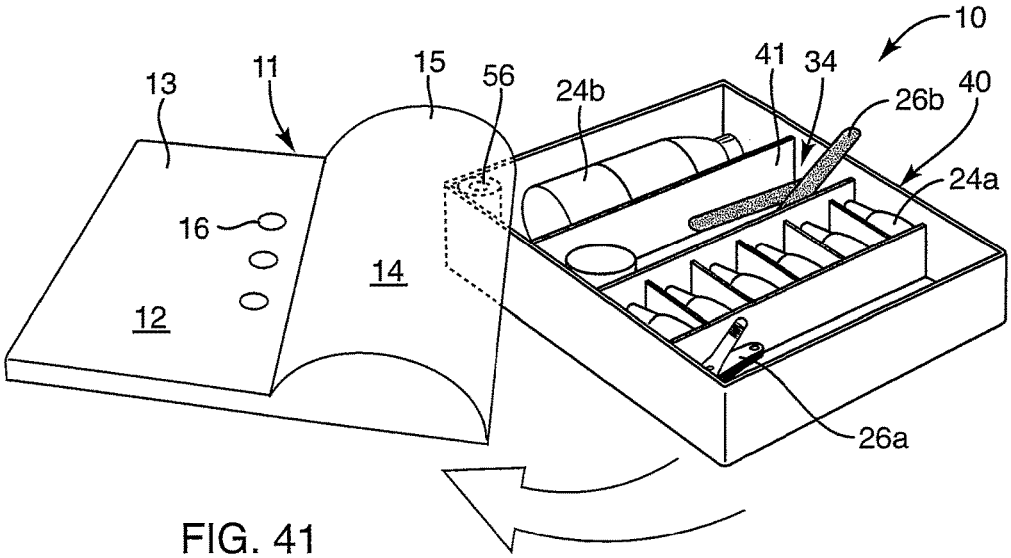
FIG. 41 is a perspective view of an alternative embodiment of an apparatus provided with a swivel that permits access to a base underneath the bed which operates as a lid for the base box or tray.

Referring to FIG. 41, in some embodiments, the lid 11 or bed 11 may actually remove the deck 12 and pillow 14 entirely, only for purposes of access, and remain connected by a pivot 56. Thus, the bed 11 moves into place over the base 40 that operates as a tray 34 subdivided by dividers 41 that define the spaces or compartments for individual materials 24*a* and tools 26*a*, 26*b*, 26*e* as illustrated.

Figure 42:
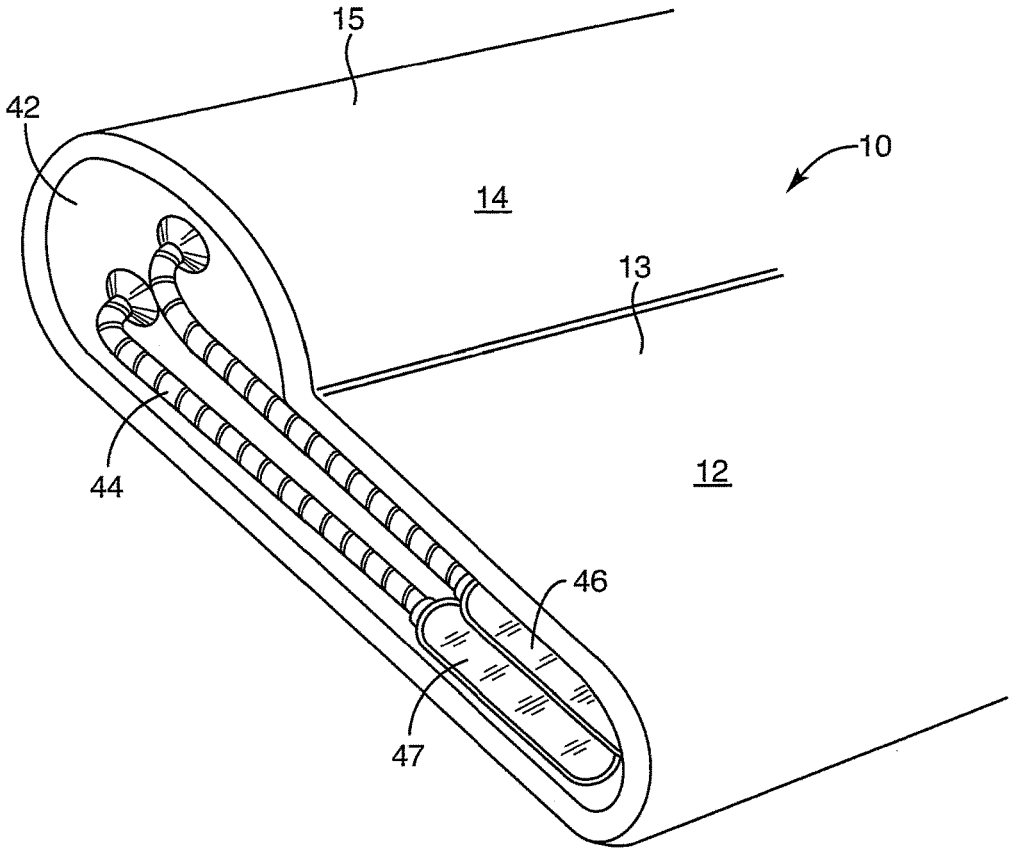
FIG. 42 is a partially cut away perspective view of the detail of a lamp, magnifying glass, such as those illustrated in FIG. 30, here in a stowed position.

Referring to FIG. 42, a detail shows the position of a magnifying glass 47 on pedestal 44 that is flexible and stable for supporting a lamp 46, a magnifying glass 47, or each. Meanwhile, batteries may be supplied and stored as a power source in the interior of the pillow 14. Meanwhile, a recess 42 or cavity 42 provides a certain amount of relief 42 for hiding or stowing the lamp 46 and magnifying glass 47.

Figure 43:
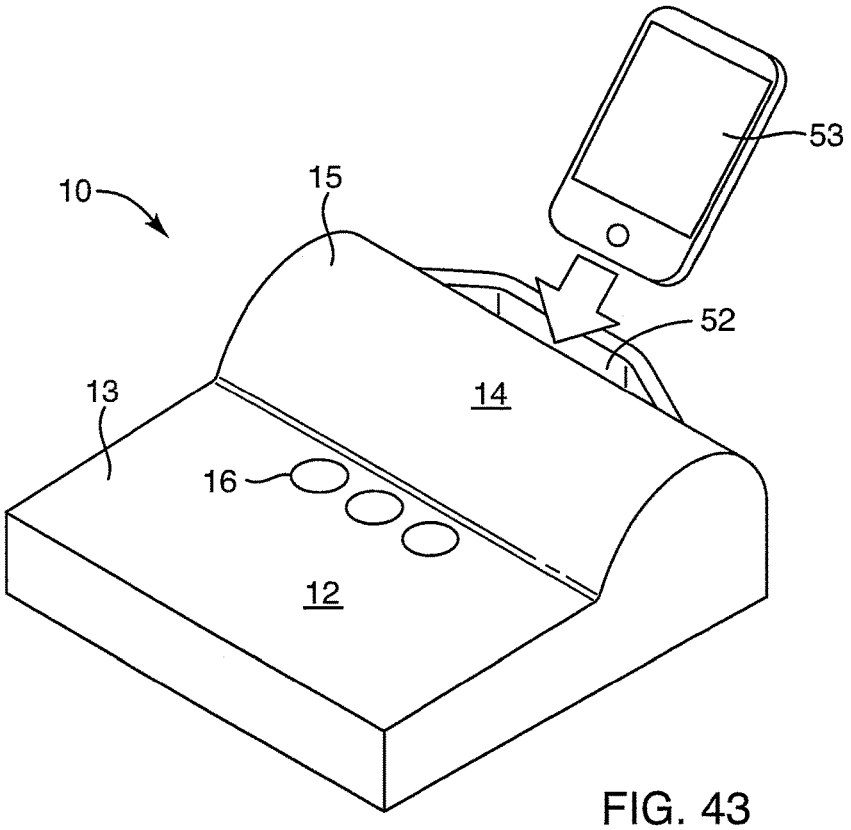
FIG. 43 perspective view of a system in accordance with the invention having a docketing station for a cell phone.
Figure 44:
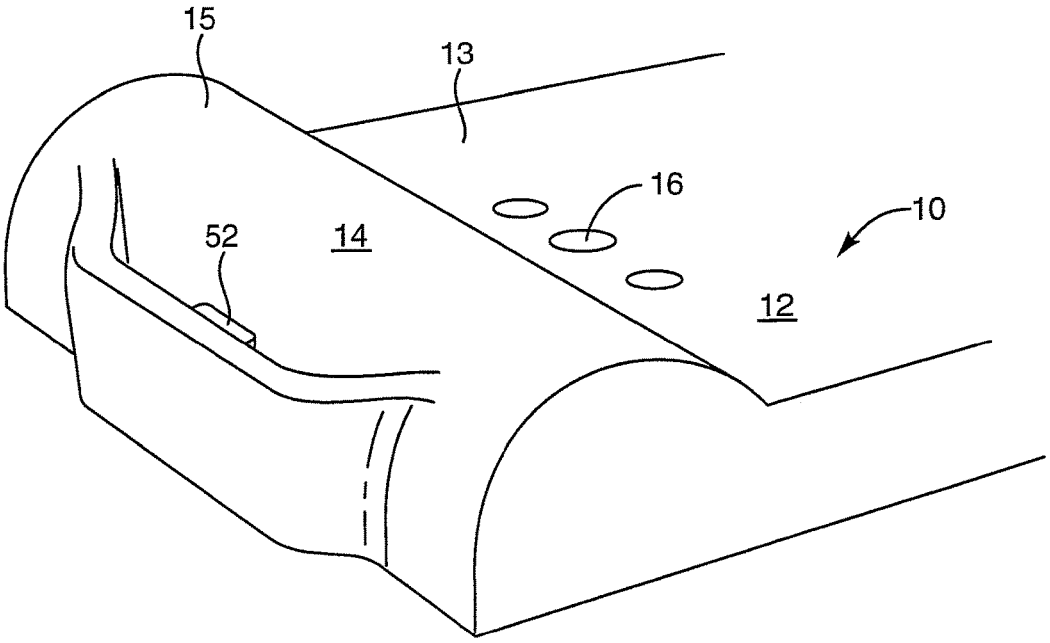
FIG. 44 is a rear perspective, partially cut away view thereof.

Referring to FIG. 44, a detail of the phone dock 52 illustrates that the connections for a phone 53 may simply be a place to rest a phone 53, or may contain the detailed dock 52 that provides electronic connections for operation thereof through speakers 51. In FIGS. 43 and 44, different perspectives show the rearward and forward view, in which the dock 52 is provided in an extended space, thus rendering the pillow 14 fully available. Nevertheless, in certain embodiments, this may change the shape of the pillow 14, and therefore its access. However, it is a matter of convenience in user selection as to whether the dock 52 will be useful, or used.

Figure 45:
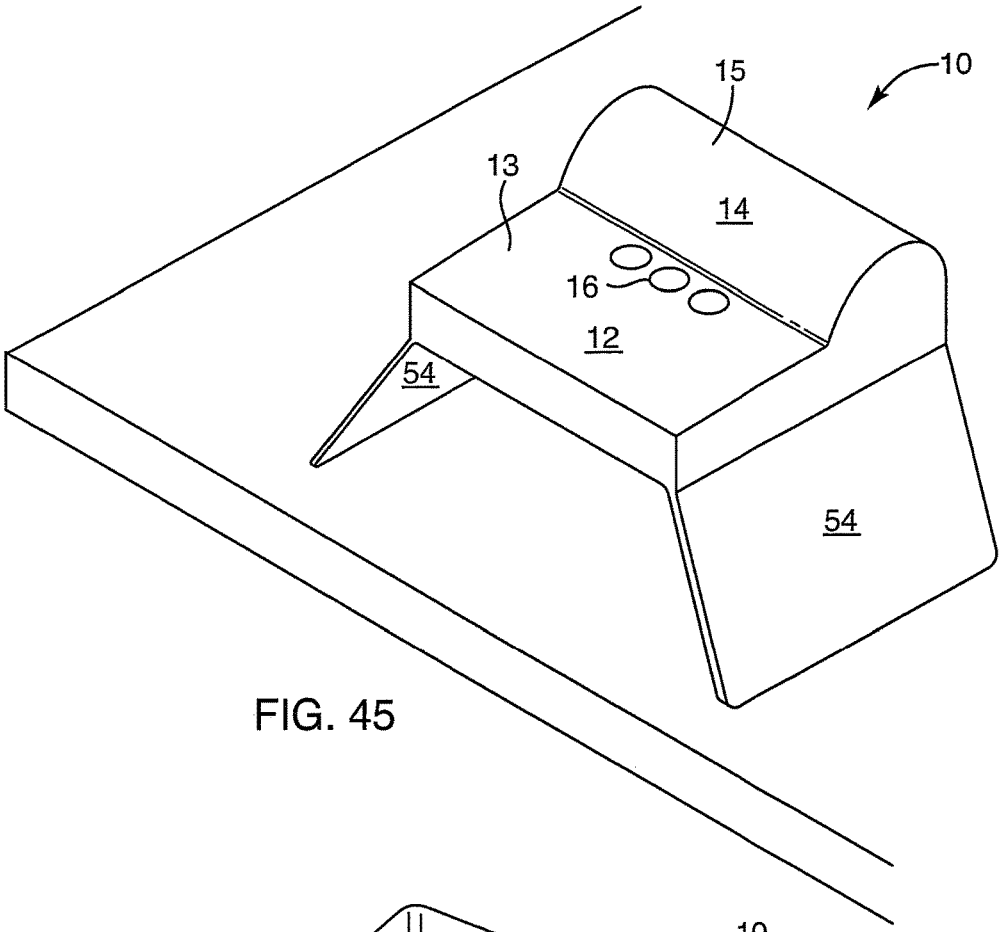
FIG. 45 is a perspective view of one embodiment of deployable wings forming legs for base of a manicure bed in accordance with the invention.
Figure 46:
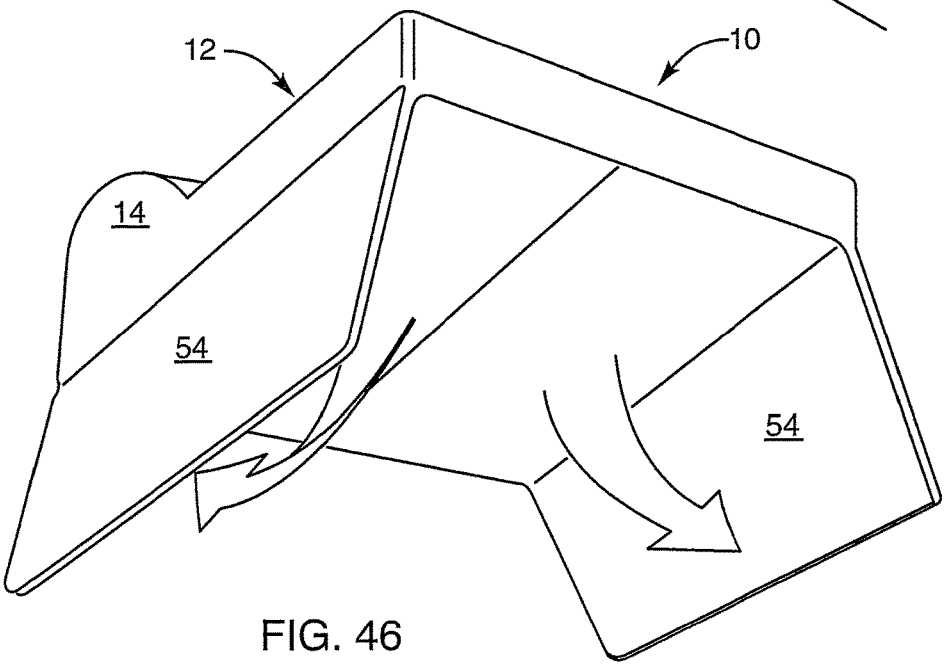
FIG. 46 is a perspective view of the underside thereof.

Referring to FIGS. 45 through 46, the system 10 may involve wings 54 that are deployable and selectively stowable underneath the deck 12 and pillow 14. By suitable securement, the wings 54 become legs 54 when unfolded from the underside of the apparatus 10. They provide convenience in fitting on a lap, elevating the deck 12 above a bed 11, or the like. Of course, the dimensions of the width from left to right may be from about twelve to twenty inches, or even twenty four inches. However, compactness is useful. Thus, a depth from front to back, from a proximal edge to a distal edge, with respect to a user need only be from about twelve to about eighteen inches. Typically, a twelve inch by twelve inch overall footprint for the apparatus 10 may be entirely suitable. However, slightly larger fourteen by fourteen, or fourteen by sixteen inches may be suitable. If a user desires to use the wings 54, then a width of from about eighteen to about twenty four inches may be more suitable for operating as a lap desk in a bed 11.

Figure 47:
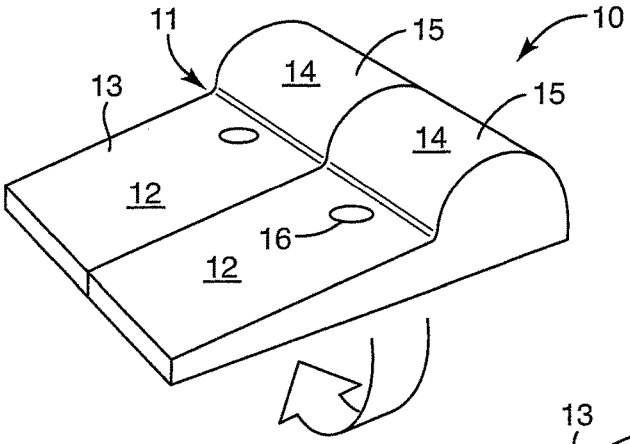
FIG. 47 is a perspective view of an alternative embodiment in which the bottom surface of a system in accordance with the invention may be hinged to fold to halves symmetrically together to reduce at least one dimension of the system.
Figure 48:
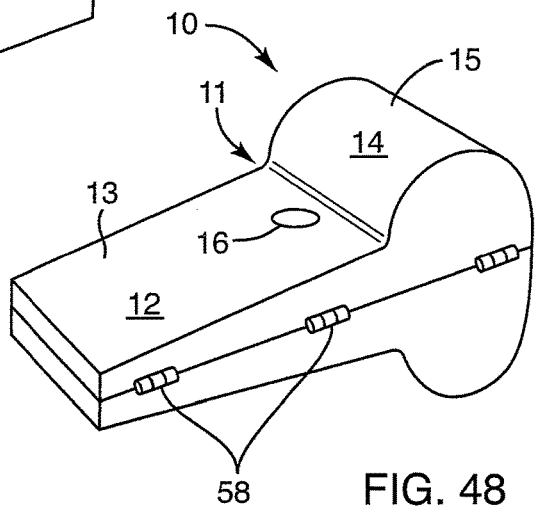
FIG. 48 is a perspective view of the system of FIG. 47 in a stowed configuration, as opposed to the deployed configuration of FIG. 47.

Referring to FIGS. 47 through 48, in certain embodiments, a hinge 58 or a series of hinges 58 may connect to halves of a bed 11. The bed 11 thus divides in order to reduce the overall footprint during storage, transport, or the like. Thus, the two halves of the bed 11 serve well, and the combination of the deck 12 and the pillow 14 maintains the system 10 flat on a lap, tabletop, floor (as a stool) or the like. However, once the center is lifted up, the two halves may fold together as illustrated.

Figure 49:
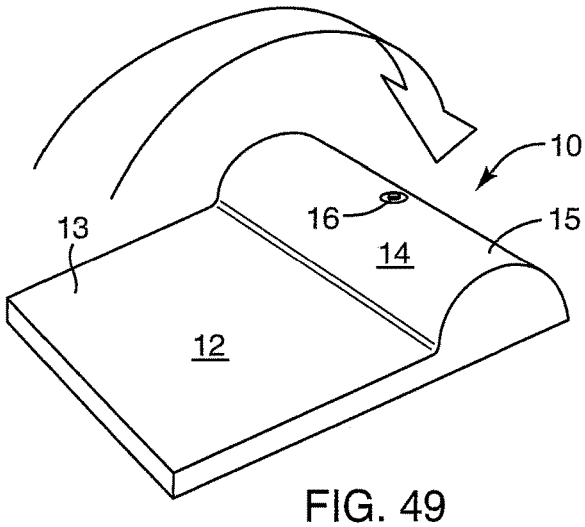
FIG. 49 illustrates an embodiment of a flexible deck portion of a system in accordance with the invention, in which the deck is sufficiently flexible to fold over the pillow portion to reduce the overall envelope (volumetric space defined by length times width times thickness) of the system when stored while providing full space for operation during use.
Figure 50:
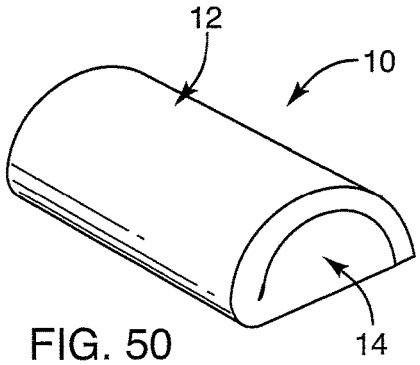
FIG. 50 is a perspective view thereof in the stowed configuration, as compared to the deployed configuration of FIG. 49.

Referring to FIGS. 49 and 50, in certain embodiments, the deck 12 may be sufficiently flexible that it will completely fold up over the pillow 14. This forms a small package with a comparatively small envelope (total volume, or footprint involving total area) for transport versus deployment. FIG. 49 shows the deployed configuration, while FIG. 50 shows the stowed configuration.

Figure 58:
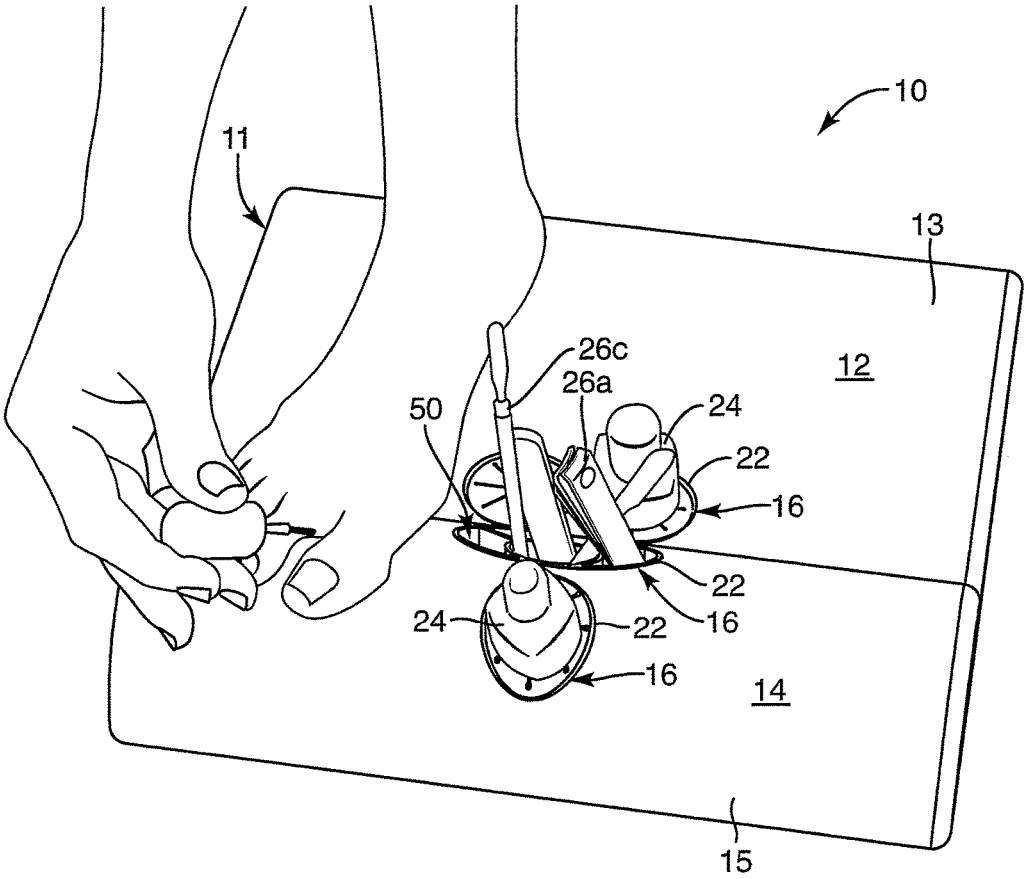
FIG. 58 is a perspective view from an opposite direction illustrating the process and apparatus of FIG. 57.
Figure 59:
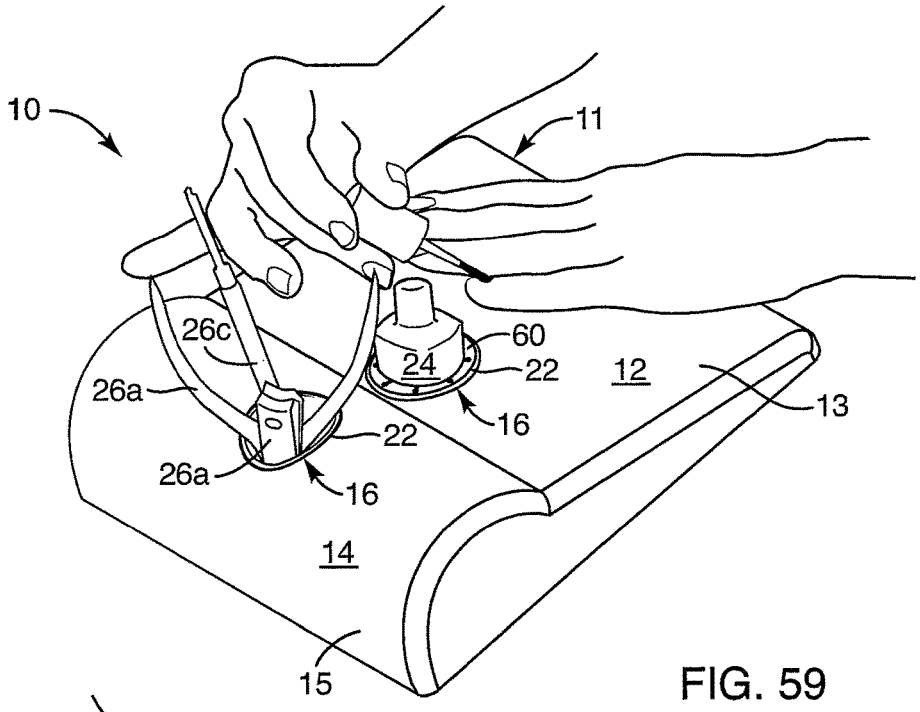
FIG. 59 is a perspective view of an alternative embodiment of a process and system (apparatus) for manicure by a subject on one's self using the bed and pillow in accordance with the invention.
Figure 60:
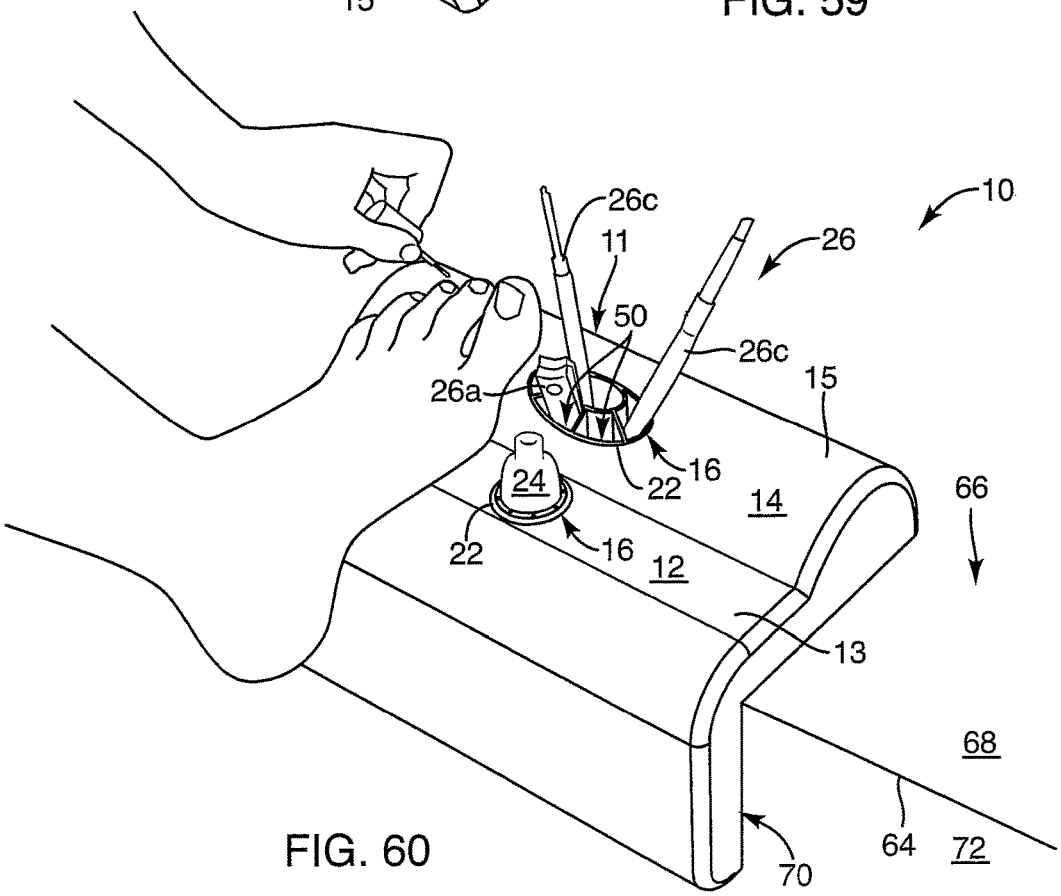

Referring to FIGS. 51 through 60, while continuing to refer generally to FIGS. 1 through 60, in certain embodiments, an apparatus 10 in accordance with the invention may be formed to include an upper or bed portion 11 and a base 40 or tray portion 34 therebelow. Any suitable type of mechanism, including snaps, slides, clamps, latches, pivots, magnets, hook-and-loop fasteners, hinges 48, 58, or the like may be used to secure a tray portion 34. The tray 34 may be characterized as a base 40, to a bed 11. In the illustrated embodiment, the tray 34 operating as a base 40 may be separable from the bed 11, rendering the tray 34 accessible for presenting in various compartments 38 separated by dividers 36, tools 26, materials 25 in various bottles 24, or the like.

Figure 51:
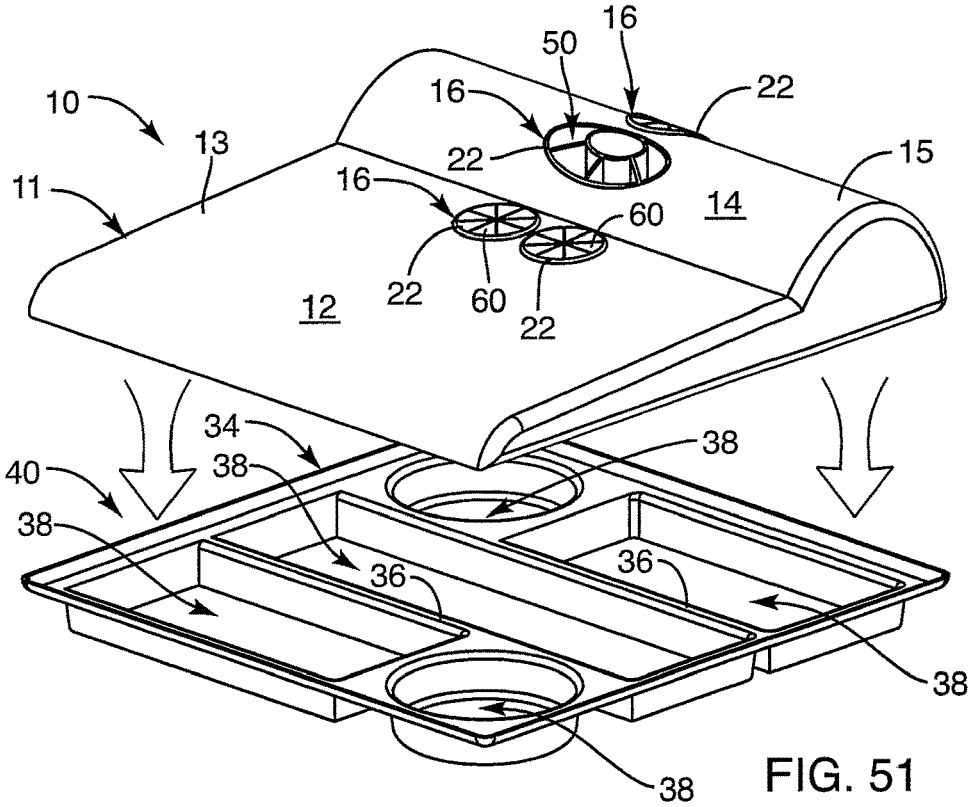
FIG. 51 is an exploded view of a system 10 in accordance with the invention wherein an upper portion is separable from a tray as a lower portion, and in which the tray is selectively securable by a slide, grip, fastener, or other engagement mechanism.
Figure 52:
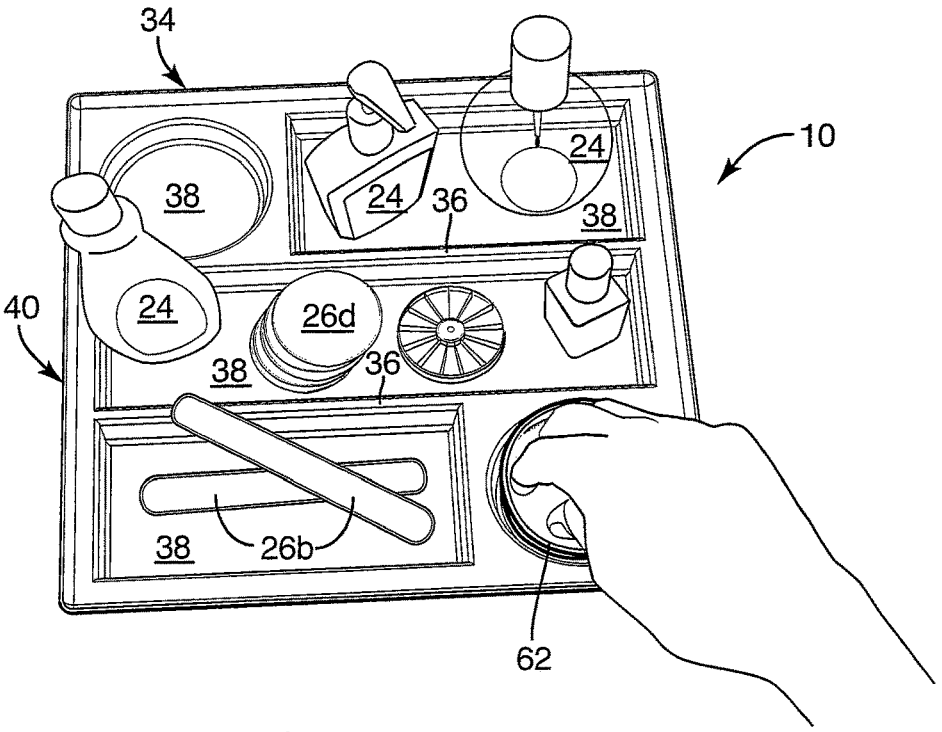
FIG. 52 is a perspective view of one embodiment of a tray of the apparatus of FIG. 51, equipped with various bottles, tools, soaking bowl, and so forth.

Referring to FIGS. 51 and 52, one may see that various materials 25 and tools 26 may be stored, and deployed from various compartments 38 of the tray 34. In the illustrated embodiment, for example, bottles 24 containing various materials 25 including lotion, polish remover, nail polish, cuticle oil, or the like may be arranged and deployed in the compartments 38.

Similarly, a bowl 62 may be provided for soaking nails. Similarly, various emery boards 26*b*, and other tools 26, such as pads 26*d* and the like may be provided, contained, and otherwise made available and easily reachable and yet stowable in a controlled environment.

One will note in the illustrated embodiment that the wells 16 are provided with cups 22. The cups 22 in some instances are provided with compartments 50 for receiving tools 26. Likewise, other cups 22 are provided with grippers 60 or keepers 60 that may flexibly deflect to provide stable support and retention of bottles 24 of various shapes, such as round, rectangular, and other shapes of bottles 24 containing nail polish, remover, and the like.

Referring to FIGS. 53 through 60, a bed 11 in accordance with the invention may be used in any of a variety of configurations and procedures. For example, referring to FIG. 53, an operator may provide services for a customer or a subject. Thus, the combination of angles available in the deck 12 and pillow 14 support the presentation of hands or feet of a user or subject for proper viewing and for execution of various procedures by an operator. In certain embodiments, the subject is the operator performing manicure or pedicure processes on one's self. In others, an individual operator is performing pedicure manicure procedures for a subject.

Figure 53:
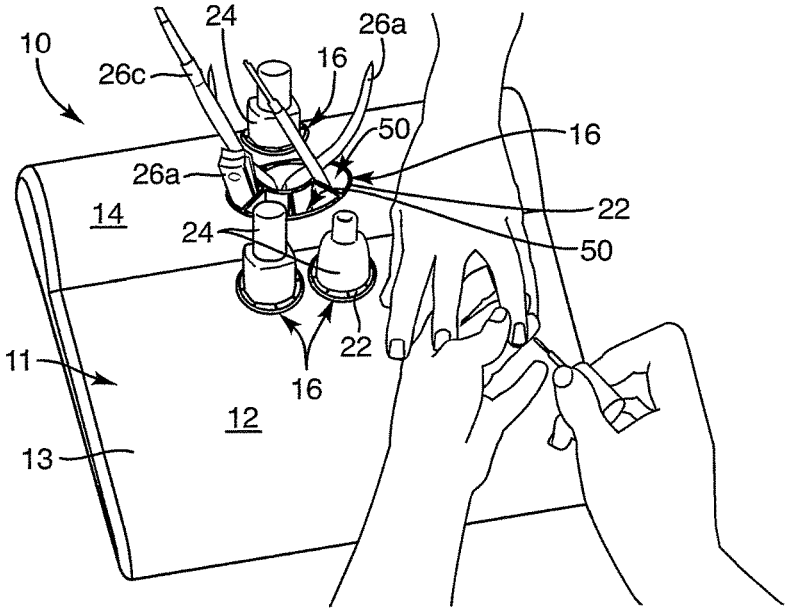
FIG. 53 is a perspective view of one embodiment of a bed in accordance with the invention having a deck and a pillow or wave portion with wells in use to hold ready and accessible various bottles of material and tools necessary for a manicure executed by a provider (operator) for a subject.

Referring to FIG. 53, an operator may rest the hand of a subject across the pillow 14 in order to provide a proper presentation angle for working on fingernails. By the same token, referring to FIG. 54, an individual may self process, using the deck 12 in a different configuration for proper presentation for one's own eyes to be able to see and for one's own hands to access one another for application of nail polishing and other procedures.

Figure 55:
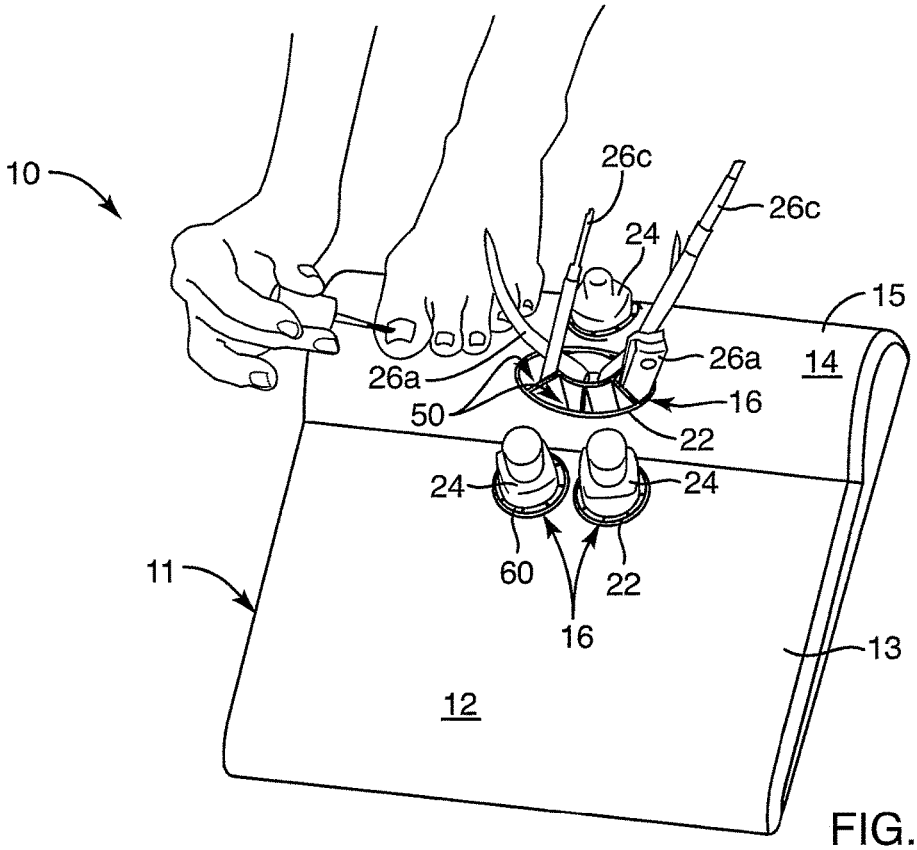
FIG. 55 is a perspective view of a bed in accordance with the invention in a mode selected for pedicure by individual on one's self, and using the wave or pillow portion to provide the proper angle of presentation.

Referring to FIG. 55, an individual may self serve or process from the back side of the pillow 14, thus presenting at a proper angle and distance the feet in order to polish or perform procedures on one's self with one's own hands.

Figure 56:
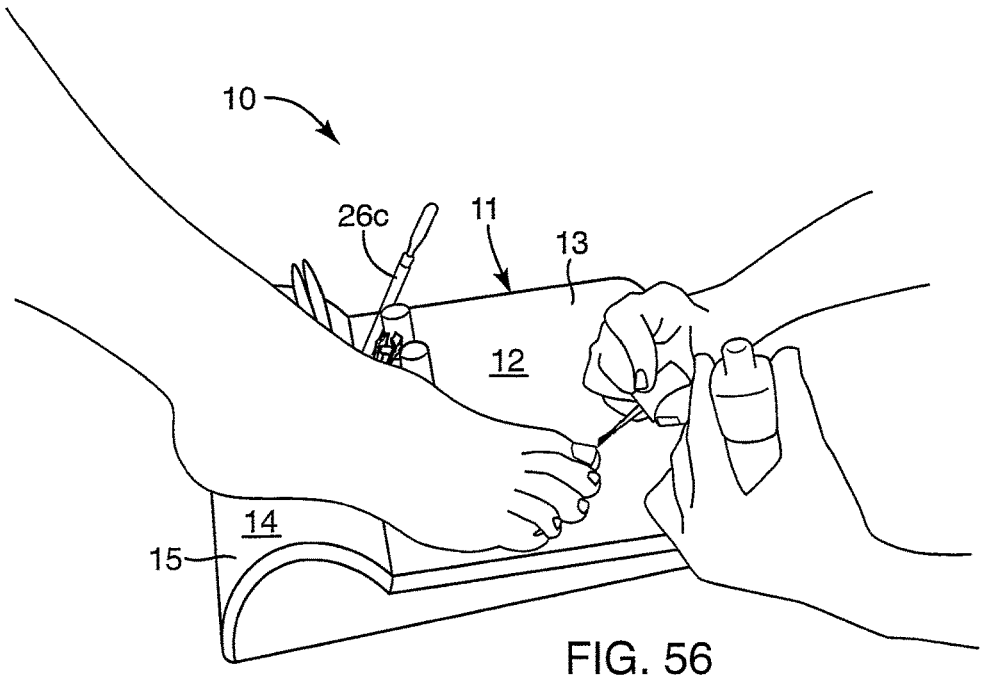
FIG. 56 is a perspective view of an alternative embodiment of a bed in a procedure for pedicure in which an operator is providing services for a subject.

Referring to FIG. 56, an operator may provide procedures on the feet of a subject whose feet are draped over the pillow 14 in such a way as to provide proper distance, viewing angle, stability, and presentation access for procedures such as pedicure processes, nail painting (polishing), and so forth.

Figure 57:
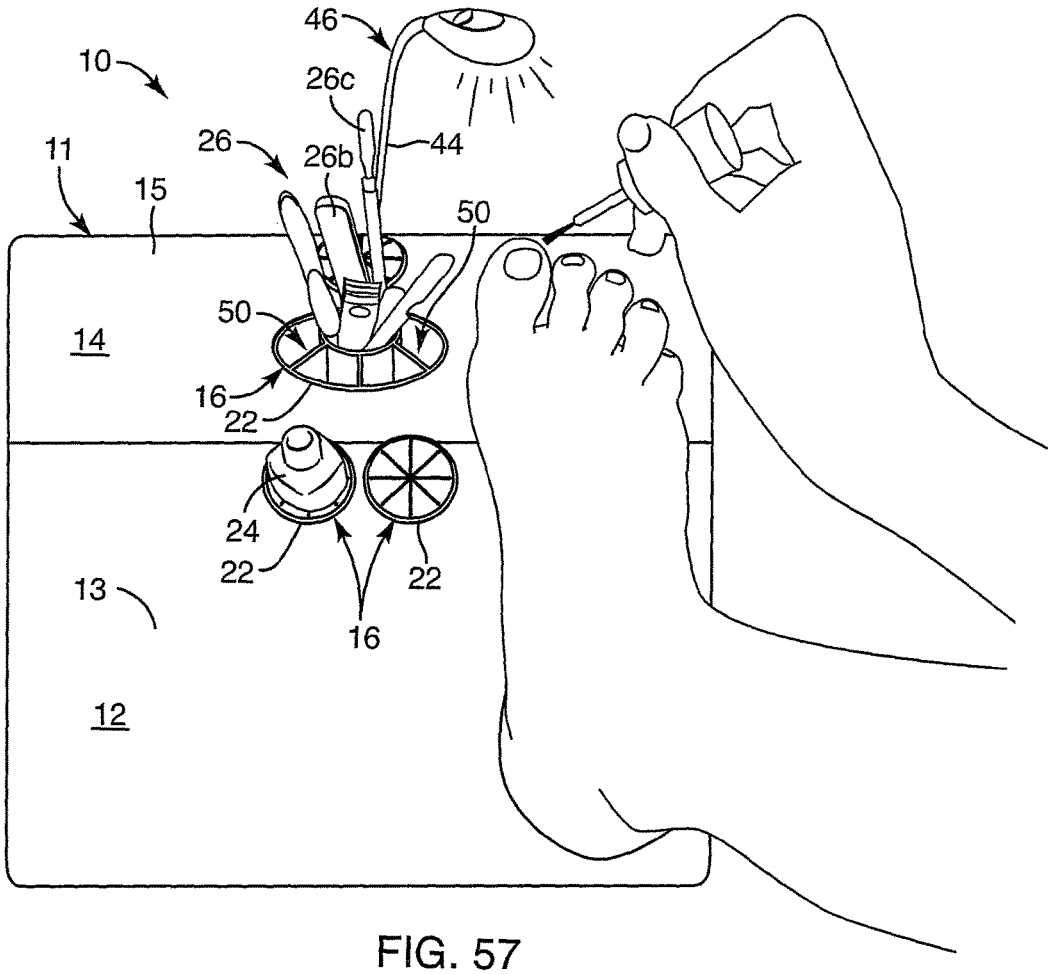
FIG. 57 presents an alternative embodiment of a system and process using a bed in accordance with the invention, this for a pedicure by a subject on one's self.

In contrast, referring to FIG. 57, an individual may provide pedicure or toe nail polish for one's self. This requires yet a different angle of the foot on the deck 12 and pillow 14 in order to provide a proper angle, distance, visibility, and so forth. Note that a light 46 is shown which may be or include a magnifying glass, light, or both. It may provide improved visibility of detail. Meanwhile, the pillow 14 provides a proper angle in order to have visibility and access for various procedures.

Referring to FIG. 58, an alternative angle provides a view of the same operation or procedure illustrated in FIG. 57. One will note that the view is much better for a user providing self service procedures and significantly different from that of FIG. 56.

Figure 54:
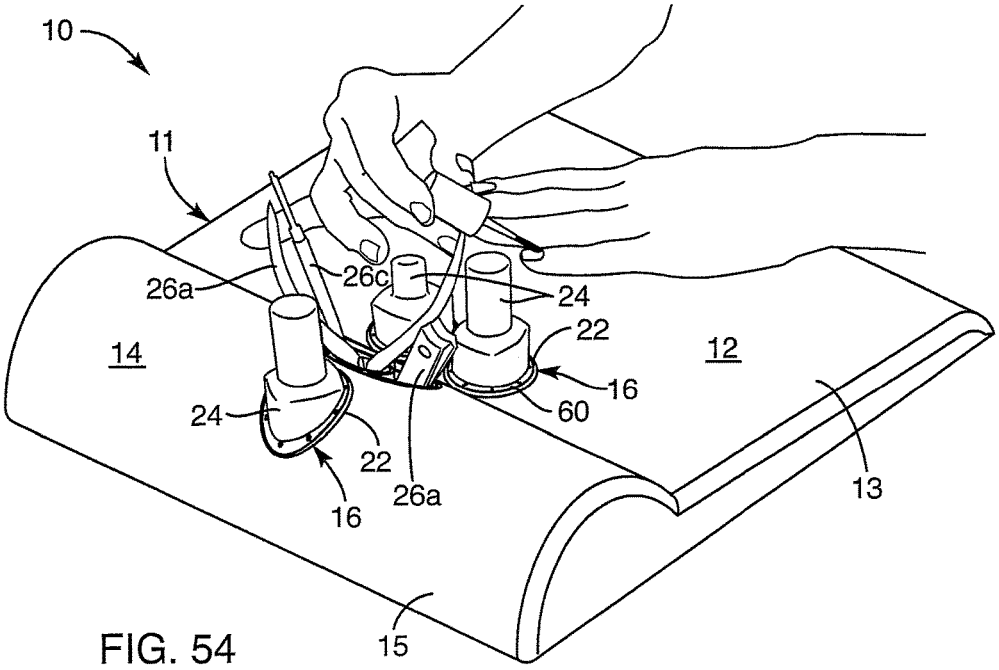
FIG. 54 is a perspective view of a bed in accordance with the invention, this being used by an individual for self manicure or nail polishing (painting)

Referring to FIG. 59, a procedure similar to that of FIG. 54 is illustrated, this using a smaller, more portable, and somewhat abbreviated system 10. A system 10 may be rectangular or square, having a width across the edge of the deck of from about eight to about 18 inches. A target width is about 12 inches. The depth or length across the deck and pillow is from about eight to about 18 inches, with a target depth of 12 inches. The unit 10 of FIG. 59 has a target depth and width of about eight inches each. One will note that a single well 16 is provided for a bottle 24, such as polish or lacquer, and a single, non-compartmentalized well 16 is provided with a cup 22 lacking the compartments 50 of the system 10 of FIGS. 51 through 58.

Referring to FIG. 60, in one embodiment of a system 10 in accordance with the invention, certain users may prefer to operate near an edge 64 of a table 66 or counter 66. The apparatus 10 sits flat on the top surface 68 of the table 66 or counter 66. Meanwhile, a skirt 70 or flank portion 70 may extend down along a front face 72 of the table 66 or counter 66. This may be of particular use for a less agile individual user. If it is preferred, one may bend the knee and hip in order to present feet closer to the eyes of a user, and more readily assessable for various procedures. Thus, in this embodiment, an individual may sit in a seat and bring the feet up by using a coffee table 66, stool 66, counter 66, bench 66, or the like.

In certain embodiments, a system 10 may be from about 8 to about 18 inches wide from left to right for a user, and from about 8 to about 18 inches deep from front to back with respect to a user. A target distance that has been found particularly suitable to balance adequate work space with suitable portability is about 12 inches by 12 inches. In contrast, a compact and more portable system 10 as illustrated in FIG. 59 may have target dimensions about eight inches square.

In certain aspects of systems 10 in accordance with the invention, a skin 20 may be a chemically equivalent material to that of the main body 18. In other embodiments, the skin 20, coating 20, sealant 20, or the like may actually be formed of an entirely different material. For example, many suitable and inexpensive materials are available for forming the body 18. However, many of those materials, such as polyurethane, polystyrene, and the like may be readily attacked by the chemical composition of polishes (paints), polish removers, other solvents, cleaners, alcohol, and so forth. Thus, in selected embodiments, a skin may be painted on, draped over and sealed by adhesive or chemical bonding to the body 18, placed into a mold as a liner material after which the material of the body 18 may be added to fill the mold, or secured by any suitable method of chemistry, adhesive, or fastener to become integrated with the body 18.

To the end of providing a proper sealant 20, coating 20, or skin 20 protecting the body 18, it was desired to render it impervious and chemically non-reactive with cleaning solvents such as acetone and high purity alcohols. Thus, the selected material is not attacked by the materials 25 used in a manicure or pedicure system 10. A suitable material for the skin 20 should be suitably formable.

For example it may be preformed (before backing by the foam body 18) in its final shape, post-formed by being draped as a flexible sheet over the body 18 acting as a shaping mold for the skin 20, or the like. In other embodiments, the polymeric material of the skin 20 may be applied to an inside surface of a mold before the body receives for molding the principal polymer forming the body 18.

Suitable materials are sold under various trade names. For example, a polymer sold under the trademark of SHOCK TEC® brand of polymeric "gel" has been found to provide a comparatively soft and compliant surface very comfortable for resting a hand or a foot thereon. Meanwhile, this particular resin product has been found after curing to be impervious to liquids, and not attacked by the solvents common to cleaning agents, polish remover, nail polish, acetone, high purity alcohol, and so forth.

The SHOCK TEC GEL® brand of polymeric gel has been found to be resistant to all of the common chemicals used in treatment of nails. These include oils, alcohols, acetone, and so forth. Meanwhile, the material has shown to be hypoallergenic, fungus resistant, and non-toxic. Moreover, since it is not a derivative of latex nor silicone, it does not present the allergy issues that those materials do. The material that is safe for soap, water, chemically pure rubbing alcohol, nail polish, acetone solvents, common cleaners, disinfectants, antiseptics, and so forth provides a valuable benefit to a system 10 in accordance with the invention.

The actual stiffness or hardness of the surface is sufficiently soft to deform under the weight of hands and fingers, thus providing a plush, cushioned feel. This also indicates that it does not suffer from the stiffness and hardness that is typical of self-skinning, expanded polymeric materials. Users need an alternative to towels, which tend to be too soft and have a nap that interferes. Bare table tops or arms of chairs are typically too hard, stiff, or both. They need not be the ultimate determinant of the feel and function of the outer surfaces 13, 15.

The SHOCK TEC® gel is a viscoelastic polymer. Such polymers are synthetic, and some may contain a certain oil fraction. Manufacturing processes and their cure times are proprietary, and it is unknown whether the material is available as a thermoplastic, thermoset, or both, as is the manufacturing process. However, the product can be found currently at the URL of www.kimmerlerproducts.com.

The skin 20 need not have a particularly thick layer. It may be less than ⅛ inch thick, and perhaps even less than 1/16 of an inch thick. The thinner the skin 20, the more reliant it is on the stiffness or softness of the underlying body 18. The material of which the body is made will have more influence on the physical compliance properties if the skin 20 is comparatively thinner, and less influence as the skin 20 is applied to be comparatively thicker.

Thus, the use of such a material provides protection as a coating 20 or skin 20 of the body 18. The skin of a system 10 provides satisfactory results for protection, feel, gripping friction against sliding of tools, and appearance. Protection against damage is but one benefit, important, but one. An ability to be cleaned in order to always be hygienic is equally important. It appears to be available in several colors as well, In certain embodiments, the skin 20 may be formed in a color similar to that of the body 18. In alternative embodiments, the skin 20 may provide its own unique coloring, whether transparent, translucent, or opaque. It has been found that the skin 20 may be formed in bright colors or subdued neutral colors. Thus, whether a bright orange, bright blue, bright yellow, or the like is desired, or a rather subdued sand, brown, gray, charcoal, or the like, the skin 20 may contribute to the aesthetics as well as the protection of the system 10.

It is noteworthy that a system 10 in accordance with the invention is suitable for resting a hand or a foot of an individual user acting as an operator on one's own foot or hand. In this configuration, an individual user (performing processes for one's self) will typically be seated with the front edge of the deck 12 closest to the user. A hand or foot rests on the deck 12. The extremities (fingers or toes) may bend up to rise for better viewing and access by resting against the front of pillow portion 14.

Thus, as illustrated in FIGS. 57 and 58, the toes may be elevated and bent somewhat by the rise of the pillow 14 away from the deck 12. Meanwhile, the fingers may be similarly disposed to present the nails. Likewise, the nails may simply rest on the flat deck 12, being painted while the fingers rest directly as in FIG. 59.

In contrast, when an operator is conducting processes on the hands or feet of another individual (e.g., customer, friend, client, etc.), then the operator may use the configurations of FIGS. 53 and 56. In the embodiment of FIG. 53, the hand or wrist of a subject may rest on the pillow 14 above the deck 12. In the illustration, the fingers extend downward, whether straight or curved. This presents the nails of a subject to an operator at a suitable angle for viewing.

Similarly, the heel, arch, or ball of the foot of a subject may rest on the pillow 14. This present the toes on the deck 12 closer to and at an angle suitable for viewing and access for processes conducted by the operator in FIG. 56.

None of this precludes a single individual user from conducting processes on one's self. For example, see the system 10 in the embodiment of FIG. 55. Here, as in FIG. 60, a user may rely on an edge of a supporting surface, such as a table or counter. The edge and corner provide relief or space for placing the heel of a foot at another angle, closer to vertical. This provides a better angle and space to bring the foot closer to the eyes and shoulders to present the nails of the toes for treatment.

Of course, in each of these configurations, including the basic configuration of FIGS. 54 and 59, in which the subject is the operator conducting the procedures, the tools 26 and bottles 24 may be suitably arranged in the wells 16. Of course, cups 22, such as those having compartments 50, the tools 26, such as clippers 26*a*, boards 26*b*, sticks 26*c*, pads 26*d*, blocks 26*e*, or the like may be oriented in a suitable orientation for easy reaching and grasping.

For example, as discussed hereinabove, drawing fingers together is required to pick up a small diameter or cross section of a tool 26 on the surface 13 of the deck 12. This is true for a table, counter, arm of a chair or couch, any other work surface or adjacent staging surface. Such a table, counter, or other surface will usually smudge, wipe off, or otherwise damage an uncured polish on the corresponding nails.

In contrast, having the compartments 50 sufficiently narrow across their maximum dimension of their cross sections solves the problem. Think of effective diameter as a diameter, regardless of shape. It is an engineering concept called hydraulic diameter (4× cross sectional area divided by the internal contiguous perimeter or "wetted perimeter" in fluid terms).

Here, the compartments 50, have an aspect ratio of "effective diameter" divided by height, to be considered "narrow." Being sufficiently tall in their height, for example, several effective diameters tall, limits the angle of repose at which an object can extend from the bottom thereof and out the top opening. This angle is selected to assure that a tool 26 may be readily isolated and grasped between a thumb and forefinger, or between the thumb and another finger, without damage to the undried or otherwise uncured nail treatments on the hand grasping the tool 26.

This assurance arises is because the digits can approach one another without the nails contacting a surface parallel to their motion toward one another. That latter condition exists on virtually any horizontal surface of repose on which any tool of small effective diameter may lie. Not so with the wells 16 and compartments 50 designed for tools 26 in accordance with the invention.

The concept of a light 46 may be implemented in any of a number of configurations. For example, lights 46 are illustrated on mounts set into the pillow 14, into the sides or side surfaces of the body 18, and may also be treated as accessories to be fitted in one of the wells 16. Thus, a light 46 may be implemented in any of several configurations, and even multiple configurations on a single system 10.

For example, two lights 46 in different directions may provide better viewing, especially for details when trying to complete precisely the application of a nail polish to a nail. Accordingly, a combination of a light 46 and any suitable type of a pedestal 44 or other extension 44 may be implemented. Moreover, batteries may be included in a lighting unit 46, and may even serve as a holder fitted to a well 16 or other aperture elsewhere in the body 18.

Another benefit of an apparatus 10 and method in accordance with the invention is the ambidextrous access the system 10 provides. For example, in the embodiments of FIGS. 51 through 60, a left hand or left foot may be rested on the deck 12, pillow 14, or both. Either right or left hand may be draped over the pillow 14, or presented on the deck 12, for either a subject being treated by an operator, or by an individual treating one's self to a manicure or pedicure.

It is not practical to illustrate every position in which a hand or foot may be placed on the system 10. However, one may see from the illustrations presented that whether speaking of one or two persons, access and presentation are suitable. Both a subject conducting procedures on one's self and a subject being treated by another operator may comfortably rest. Either hand or either foot may be visible and accessible for treatment from either side (front edge of the deck 12 or the back edge of the pillow 14), as necessary.

In certain situations, one may even place a hand with the fingers splayed apart over the pillow 14, and the thumb on the deck 12 during drying or application, or other treatment. This provides yet another way to separate the fingers from one another for better access, and various procedures requiring separation of the digits from one another.

In certain embodiments, the base 40 may be provided with feet to grip or provide a non-slip surface against a supporting surface of a countertop, tabletop, or the like. In certain embodiments, feet may also be placed under the body 18 in order that it not slip when placed on the surface of a table, counter, couch, or the like. As seen in the various embodiments, the compartments 38 in the tray 34 may provide relief or recesses for feet that extend some nominal distance away from the under surface of the body 18.

The body 18 may or may not have a bottom surface also coated with the protective skin 20. Thus, in the illustrated embodiments, the under surface is completely unremarkable, being a completely flat surface. Alternatively, it may have a system of fasteners to secure the tray 34 thereto, feet, as discussed, or the like. A slide engagement in which a c-shaped channel secures a sliding blade-like edge of the tray 34, or vice versa may secure the tray 34 to the body 18. Penetrations with detents to grip protrusions extending up from the tray 34, or vice versa will also work. Hook-and-loop fasteners will work, as will latches, straps, hinges, clips, and so forth.

Rails extending horizontally from the sides of the body 18 and extending all or parts of the distance from front to back may actually be placed above the bottom of the body 18. Thus, the sides of the tray may extend upward, each having a "way" (e.g., c-shaped channel) fitting to slide along a corresponding rail. The bottom of the body 18 may have a gripping, flat surface, yet the removable tray 34 has a ready engagement mechanism. Of course, with a reversal of roles, a channel extending along the body 18 may receive a rail extending theretoward from the side wall of the tray 34.

Also, as an alternative to a flat base, feet may be small rectangles of a suitable elastomeric polymer that has resilience and grip. Feet may be comparatively small in area, and placed at each of the corners of the body 18, as strips in either front to back or left to right directions, or the like.

Typically, the materials of the tray 34 may be of suitable metal or polymeric content, and may include elastomeric polymers or other solid polymers. For example, polyethylene, nylon, polypropylene, and natural or synthetic rubber, and the like have been found suitable. They are not easily scratched, not affected by solvents, do not crack or break leaving sharp edges, and clean easily. The tray 34 may be formed of a material that is opaque or transparent. Alternatively, a translucent material that passes a certain amount of the light but not images may also be suitable.

In certain embodiments, the system 10 may be placed on one's lap while seated in a chair, on a couch, in bed, on a floor, or the like. Inasmuch as the system 10 may operate as a traveling manicure table or pedicure table, it need not be secured permanently to any other mounting system. Thus, during use one need not feel enslaved to use it in a particular way or from a particular angle. The curvature of the pillow 14 and the incline of the deck 12 provide various levels, angles, and spaces for both working on nails and for drying nails.

For example, since hands or feet may rest comfortably on the system 10, both hands or both feet of a subject may rest comfortably on the system 10 during processing or drying time. An operator and a subject may sit opposite one another. One may rely on a lap, floor, table, chair, footstool, or any relatively flat surface. An inclined surface may present difficulties if not fixed and gripping with respect to the system 10. However, with a non-slip base 40, as well as non-slip feet or bottom surface under the body 18, the system 10 can tolerate a substantial incline on a surface on which it rests.

In the illustrated embodiments, the wells 16 may include holders for bottles 24 of polish 25, one of the materials 25 that will typically be used, as well as a battery operated light feature 46, including a battery pack in many instances. Since the tray 34 is detachable as a base 40, storage of all tools 26 and materials 25 needed over a particular time, may be easily carried for travel.

The light 46 as discussed hereinabove may be centered near the back, right hand or left hand corner of the pillow 14 (typically extending out of the end of the cross section of the pillow 14. Alternatively, it may simply fit into one of the wells 16. However, one benefit of polyethylene foam (i.e., expanded polyethylene) and urethane foam (i.e., expanded polyurethane) is the flexibility and deflection supported thereby. In contrast, materials such as polystyrene (e.g., expanded polystyrene foam, or solid polystyrene) will typically not serve as well, since they tend to break or deflect permanently (i.e., yield).

Of course other alterations may include providing expandable, polymeric or elastomeric, stainless steel, or other materials formed as bowls 62 that provide greater depth than the compartments 38, while still fitting therein during use. Collapsible silicone bowls may extend up for use and fold down for storage. However, cotton pads, nail polish remover, awkward sizes of larger bottles 24, tubes 24 of cuticle oil, hand lotion, small nail art features and appliques, and other additional supplies may all be stored within various containers 24 within the compartments 38 of the tray 34.

Moreover, multiple trays 34 or separate trays 34 may also be available and placed on a supporting surface next to the system 10. Containers 24 and tools 26 or implements 26 may be provided in the compartments 38 to be selectively placed within the compartments 50 of the cups 26 set into wells 16 as discussed hereinabove. Many suitable polymers, including polyethylene, polypropylene, polyurethane, silicone, and the like, as well as stainless steel may be used for the cups 22. It is particularly valuable in the illustrated embodiments that the comparatively harder and more rigid materials of the cups 22 are easy to wash, may be regularly and easily wiped down, and may even be sterilized by solvents, cleansers, or temperature to provide cleanliness, hygiene, and clean up.

Individuals will often use a plethora of padding, newspapers, towels, cleaning cloths, and the like in order to cover and protect surrounding surfaces and materials against contamination, dust from filing of nails, chips from clipping of nails, drips from polish applicators, and so forth. Those techniques and materials are always available, but are not demanded by a system 10 in accordance with the invention.

The smaller system 10 of FIG. 59, with the smaller target dimensions of about eight inches square, provides less space for wells 16 and the cups 22 within them. Thus, one may need to have an accessory holder 22 that is smaller, and may need other bags or containers to hold tools 26, containers 24 and other materials 25 for transport, presentation during use, or both.

Likewise, the embodiment of FIG. 60 may be readily foldable. Typically, the skin 20 will render the top a non-slip surface in all of the illustrated embodiments. The skin 20 may extend across the entire bottom portion of the body 18, thus providing a simple, single, flat surface extending between all of the corners, and having no protrusions, feet, rails, retainers, or other materials extending down. If a non-slip skin 20 is used as the bottom surface, this may simplify manufacture while providing stability and grip resisting slipping by the system 10 on a supporting surface. Likewise, optional gripping materials for the skin 20 on the top surfaces 13, 15 resists slipping of the hand or foot of a subject on the upper surfaces 13, 15 during procedures.

It has been found preferable to center the wells 16 for holders 22 or cups 22 in order to provide the maximum space for a user to comfortably conduct the processes of a manicure or a pedicure. The surfaces 13, 15 of the deck 12 and pillow 14 are thus available for right hand or left hand operators, and for access by an operator to a right hand or left hand, a right foot or left foot, during procedures. Also, bottles 24, materials 25, and tools 26 are less likely to be bumped by a hand or foot. For example, a removing hand or foot does not have to pass by a well 16 filled with tools 26 on an outer edge to the right or left and of the pillow 14 or deck 12.

Meanwhile, the pillow 14 or wave 14 supports fingers and toes, imparting to them a certain bending in a natural and comfortable position. A user, moreover may select the angle of bend and the amount of bend by the position of a hand or foot with respect to the deck 12, the pillow 14, and the interface therebetween (e.g., the boundary line of demarcation therebetween). By placing a foot further forward or a hand further forward (e.g., from the deck 12 toward the pillow 14) on the pillow 14, the fingers may be bent or the toes may be bent more upwardly from the deck 12. By drawing the hands or feet backward along the deck 12, a lower position on the pillow 14 would be indicated.

Not only may the fingers and toes be presented by a subject to one's self or to another operator. The wrists, hands, fingers, toes, forearms, arch of the foot, heel, ball, or the like may be placed wherever it feels most comfortable to the subject.

In certain embodiments, bottles 24 or other containers 24 may be of various shapes, sizes, heights, and the like. Accordingly, sleeves, shims, spacers, and the like may be used within the wells 16, the cups 22, or both in order to properly position such containers 24 for suitable access, by height, angle, lateral position, or gripping fit.

Technology available for cup holders in automobiles may be applied to the cups 22 or wells 16 as appropriate. An aperture for receiving a battery pack of a light 46 may be formed into either or both of the left and right ends of either or both of the deck 12 and the pillow 14. The light may use a flexible arm extending from the system 10 to the lighting fixture. Thus, a light 46 may be positioned as best suited for a right hand or left hand user. Alternatively, a light 46 may fit into one of the wells 16, such as that toward the back of the pillow 14.

Alternative embodiments may include an incandescent, halogen, or LED light, an electronic or electronic drying fan, UV curing, or other such dryer. Built-in storage compartments may be located elsewhere outside of the system 10, or within it 10, in addition to those illustrated. Adjustable height, and a magnifying glass may all be available for individual or professional use.

The concept of a dock 52 for a cell phone 53 or various feet or legs that fold up may be a suitable part of a system 10. However, it has been found that the stability and support of a comparatively softer and flexible material for the body 18 is best supported on a comparatively flat surface, such as a table. Nevertheless, in prototypes previously manufactured, the flexibility may be controlled by engineering the density and the material of the body 18. For example, polyethylene and polyurethane are available in a wide range of densities. The density selected should permit support on a lap.

Various embodiments have been illustrated, but others may combine the same elements in various ways. The wells 16 holding containers 24, tools 26, and any other materials 25 may be centered and easily available while not cluttering surrounding space, nor interfering with procedures. The combination of the deck 12 and the pillow 14 (i.e., wave 14) provide maximum comfort while providing a plethora of positioning for hand, foot, or both. The multiple options for placement, angle, height, and the like provide for comfort of any subject. Meanwhile, fingers may bend around the pillow 14, bend up from the deck 12 to the pillow 14, drape over the pillow 14, or be splayed across it for various operations or procedures as well as drying.

Meanwhile, tapered, radiused, or beveled edges provide comfortable placement, while the compliant materials of the body 18 and skin 20 provide protection against sharp or hard edges that may cause discomfort to hands, wrists, forearms, or feet. Both the operator and the subject will find support and comfort for their hands and other appendages. They may also rely on stability of a non-slip surface 13, 15, as well as a non-slip bottom surface of the body 18.

By use of the materials selected as discussed hereinabove, the structural support and durability provide a system that is high in quality, safe, usable through many hundreds or thousands of uses, and practical for "everyday" use. In addition to the sensory appeal and the functional utility of easy cleaning of all spills, germs, and so forth, the structure is particularly comfortable compared to prior art "manicure tables" used in the prior art.

Moreover, the safe, hygienic, and attractive outer surfaces 20 or skin 20 provide color and style. The system 10 remains comparatively compact (compared to a surface on a couch arm, chair arm, or table top of 24 inches or more front to back and more distance left to right), user friendly, highly ergonomic system 10. The system 10 is resistant to causation or incidence of shock, with a comparatively light weight to be easily portable.

A carrying case may surround a system 10 for storage, travel, carrying, or the like by a handle, such as a briefcase, or a shoulder strap as with various types of totes and bags. Pockets in the case, on it, or both, may be zippered, snapped, hook-and-loop fastened, or otherwise closed. They may thereby contain various additional containers 24 and tools 26 that may be used, typically periodically but not in every instance.

Thus, a case may provide not only a protective shroud with carrying capacity but also additional storage for an alternative selection of tools 26, containers 24, and materials 25. Typically, the portability provides for easy travel and storage. Meanwhile, during operation, everything used may be placed upright, preventing spillage. Stored, the tray 34 and body 18 may stack, and multiple trays may continue stacking of materials and devices.

The ease of access to containers 24, materials 25, and tools 26 during use is particularly beneficial. Ease of storage and adaptability for use provides significant time savings, as well as organization, storage, and integrated utility of a kit representing the foregoing.

Due to convenient size, storage, and self containment, quick fix up procedures, privacy, and maintenance are immediately available without appointment, waiting time, and the like. Meanwhile, professionals may find the system 10 very useful in a professional environment. They may even provide several such units 10, along a working desk, bench, or table, so various customers or clients may be serviced with individual systems 10 on a work bench, counter, desk, couch, chair, or table. Each client or customer may leave nails resting on a dedicated unit 10 of the system 10 during all procedures and drying.

Thus, a cost effective, easily available, space, time, and otherwise efficient system 10 may be available for commercial or private use. The practicality, economy, and versatility provide a system 10 by which anyone, from an occasional user to a professional daily user, may store and use a veritable wardrobe of nail products.

The present invention may be embodied in other specific forms without departing from its fundamental functions or essential characteristics. The described embodiments are to be considered in all respects only as illustrative, and not restrictive. All changes which come within the meaning and range of equivalency of the illustrative embodiments are to be embraced within their scope.

What is claimed and desired to be secured by United States Letters Patent is:

1. An apparatus, comprising:

a workstation comprising a body and a cushioned non-slip polymer based skin, the body comprising a top surface formed to be substantially flat and inclined upward with progress along a longitudinal direction extending away from a front edge thereof, wherein the polymer based skin covers the top surface of the body, such that the polymer based skin is distinct from a material of the body, and wherein the polymer based skin is chemically resistant and impervious to at least one of alcohol and acetone;

wherein the top surface further extends continuously to form an arcuate cross section region rising and falling vertically with progress longitudinally away from the front edge of the body;

the workstation further comprising a first recess and a second recess, wherein the first recess is within the body and adjacent to the accurate cross section region, wherein the second recess is within the apex of the accurate cross section region, and wherein the first recess and second recess are sized and shaped to support at least one of materials and tools corresponding to at least one of manicure and pedicure; and the body having a flexible configuration, wherein the flexible configuration is comprised of a lower region of the body folded at an angle relative to an upper region of the body, such that the folded lower region of the body is adapted to abut against an edge of a surface.

2. The apparatus of claim 1, wherein the polymer based skin is less than ⅛ inch thick.

3. The apparatus of claim 1, wherein the polymer based skin is less than 1/16 inch thick.

4. The apparatus of claim 1, wherein the polymer based skin is compliant with pressure from the skin of a subject.

5. The apparatus of claim 4, wherein the polymer based skin deflects within the same order of magnitude of the deflection of the skin of the subject resting on the top surface of the body.

6. The apparatus of claim 1, wherein the body is homogeneously molded of an elastomeric polymer as an expanded polymer.

7. The apparatus of claim 6, wherein the expanded polymer is molded to provide recesses in the expanded polymer to serve as the wells.

8. An apparatus comprising:

a first surface formed to substantially flat and inclined upward with progress along a longitudinal direction extending away from a front edge thereof;

a second surface extending continuously from the first surface to form an arcuate cross section region rising upward and falling downward with progress away from the front edge;

the first surface further comprising one or more first recessed compartments adjacent to the second surface, wherein the first recessed compartments further comprise one or more flexible securement members;

the second surface further comprising one or more second recessed compartments near an apex of the second surface;

a non-slip cushioned skin covering the first surface and the second surface, wherein a material of the skin is distinct from a material of the first surface and second surface, and wherein the skin is substantially impervious to at least one of alcohol and acetone; and the first surface having a flexible configuration, wherein a lower region of the first surface is bent at an angle relative to the second surface, such that the bent lower region is adapted to abut against an edge of a third surface.

9. The apparatus of claim 8, wherein the skin is less than ⅛ inch thick.

10. The apparatus of claim 8, wherein the skin is less than 1/16 inch thick.

11. The apparatus of claim 8, wherein the skin is a visco-elastic polymer compliant with pressure from the skin of a subject within the same order of magnitude of the deflection of the skin of the subject resting on the body.

12. The apparatus of claim 8, wherein the first surface and the second surface are homogeneously molded of an elastomeric polymer as an expanded polymer.

13. The apparatus of claim 12, wherein the expanded polymer is molded to provide recesses in the expanded polymer to serve as the wells.

14. An apparatus comprising:

a platform having a first surface and a second surface;

the first surface having a substantially flat top and inclined upward with progress along a longitudinal direction extending away from a front edge thereof;

the second surface extending continuously from the first surface to form an arcuate cross section rising upward and falling downward with progress away from the front edge;

a first compartment disposed at the first surface and adjacent to the second surface;

a second compartment disposed at the second surface near a high top region of the second surface, wherein the second compartment is above the first compartment;

a skin covering the first surface and the second surface, wherein a material of the skin is distinct from a material of the first surface or the second surface, and wherein the skin is substantially impervious to at least one of alcohol and acetone; and the platform comprising a folded configuration, wherein the folded configuration is comprised of a lower region of the platform folded at an angle relative to an upper region of the platform.

15. The apparatus of claim 14, wherein the lower region is folded at about a 90-degree angle relative to the upper region.

16. The apparatus of claim 14, further comprising a lighting member coupled to the platform.

17. The apparatus of claim 16, wherein the lighting member is further comprised of an elongated member having a lighting component.

* * * * *